United States Patent [19]

Adamski et al.

[11] Patent Number: 4,896,619

[45] Date of Patent: Jan. 30, 1990

[54] HEMMER SEAMER ASSEMBLY

[75] Inventors: Maximilian Adamski, Palatine; Robert L. Kosrow, Hoffman Estates; Stephen Ruderman, Oak Park, all of Ill.

[73] Assignee: Union Special Corporation, Chicago, Ill.

[21] Appl. No.: 256,781

[22] Filed: Oct. 11, 1988

Related U.S. Application Data

[62] Division of Ser. No. 162,919, Mar. 2, 1988, Pat. No. 4,800,830.

[51] Int. Cl.[4] ..... D05B 27/04

[52] U.S. Cl. ..... 112/306; 112/307; 112/308; 112/314

[58] Field of Search ..... 112/306, 307, 308, 309, 112/304, 303, 314, 121.15, 121.12

[56] References Cited

U.S. PATENT DOCUMENTS

| | | | |
|---|---|---|---|
| 3,589,320 | 6/1971 | Beazley | 112/309 X |
| 3,693,561 | 9/1972 | Hrinko, Jr. et al. | 112/308 X |
| 3,727,567 | 4/1973 | Beazley | 112/309 X |
| 4,019,447 | 4/1977 | Blessing et al. | 112/308 X |

*Primary Examiner*—H. Hampton Hunter
*Attorney, Agent, or Firm*—Powell L. Sprunger

[57] ABSTRACT

A hemmer seamer assembly comprising an apparatus for positioning a chain of stitches for stitching onto fabric having a needle and a throat plate, including a device for positioning the chain of stitches forwardly of the needle, and a device for moving the fabric to the throat plate for sewing the chain onto the fabric.

8 Claims, 17 Drawing Sheets

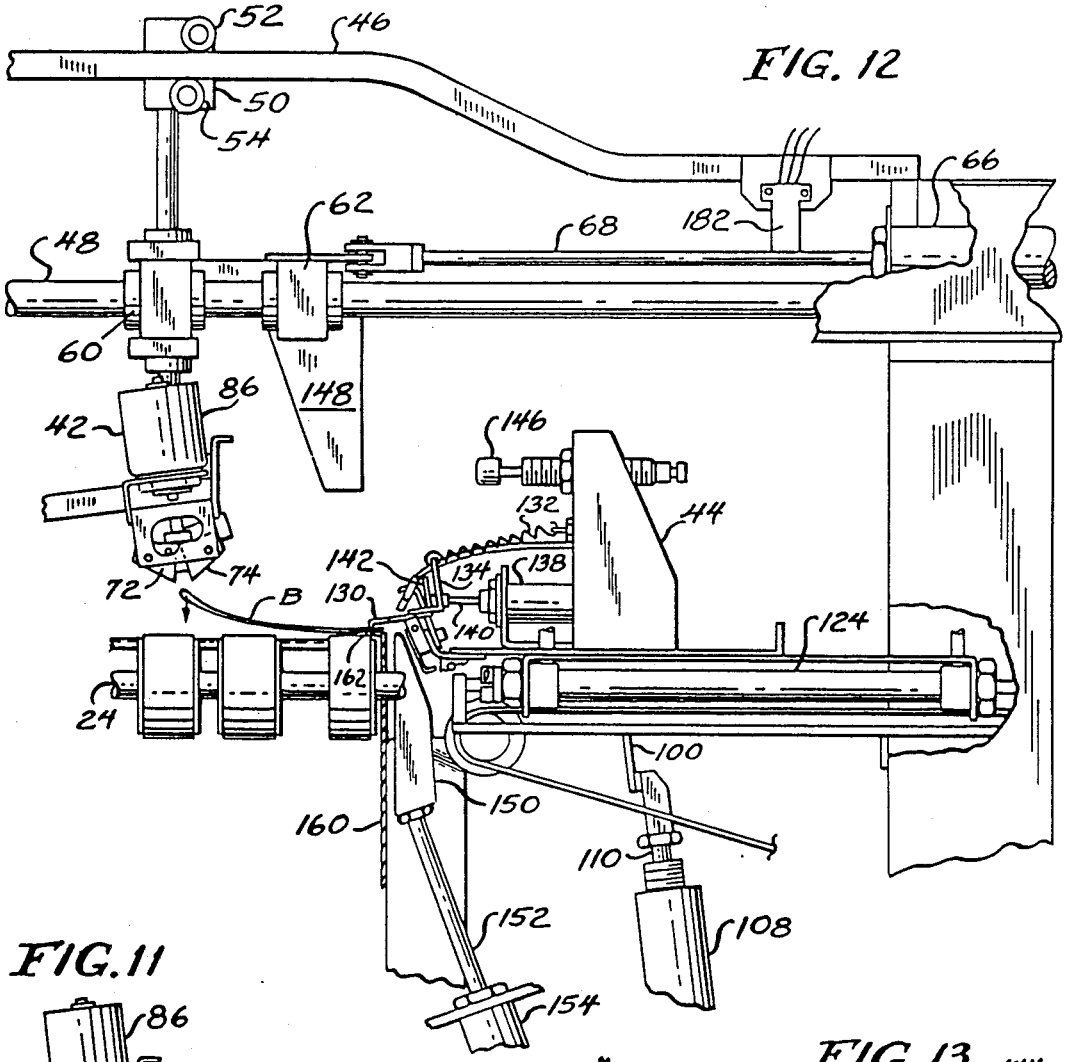
FIG. 12
FIG. 11
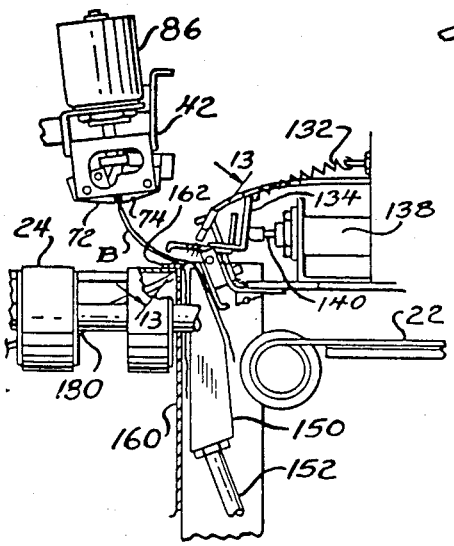
FIG. 13
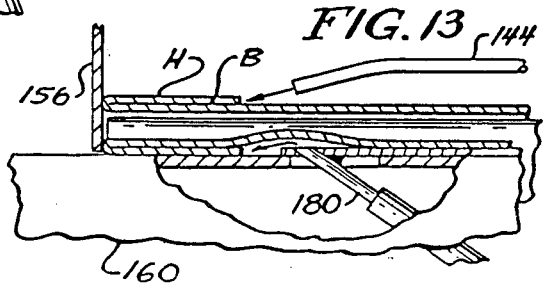

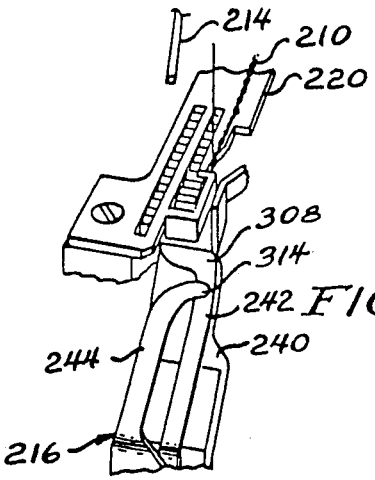
FIG. 26
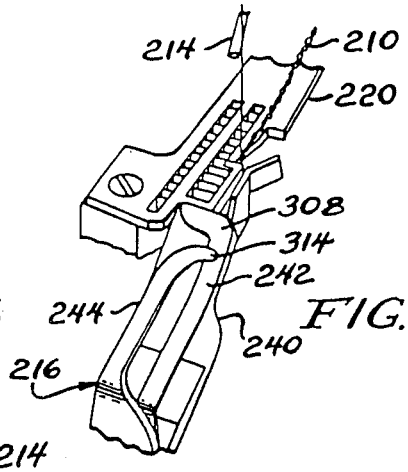
FIG. 27
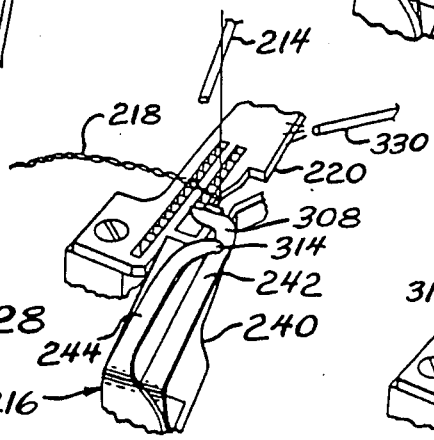
FIG. 28
FIG. 29
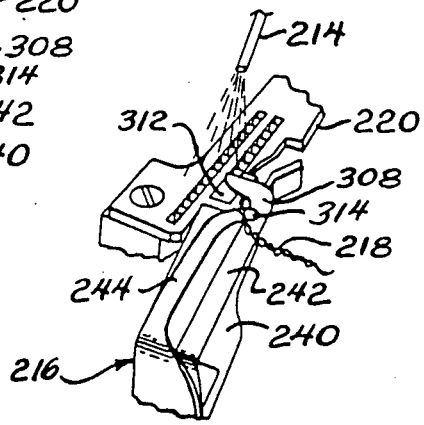
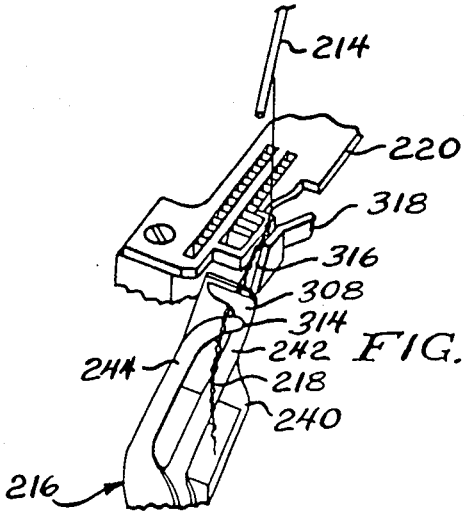
FIG. 30

FIG. 31
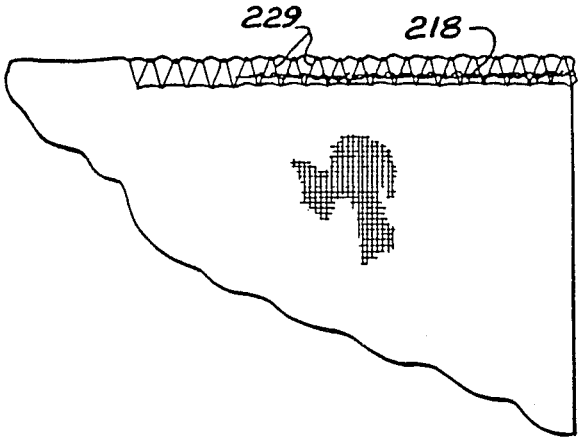
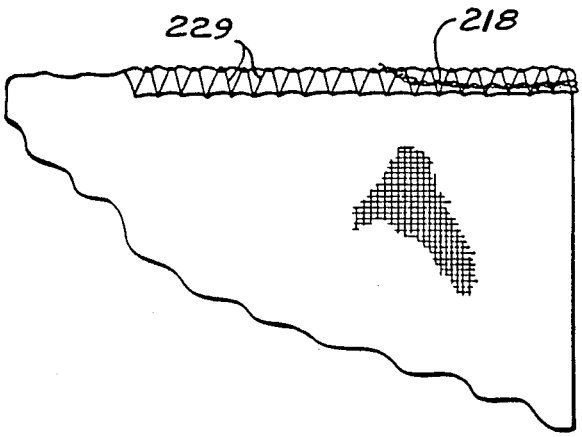
FIG. 32

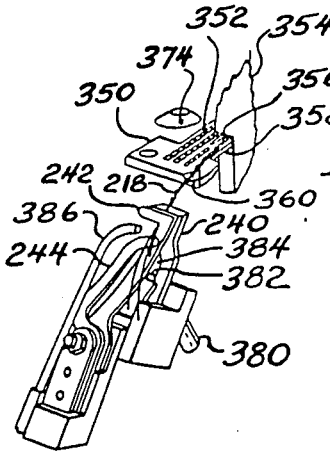
FIG.33
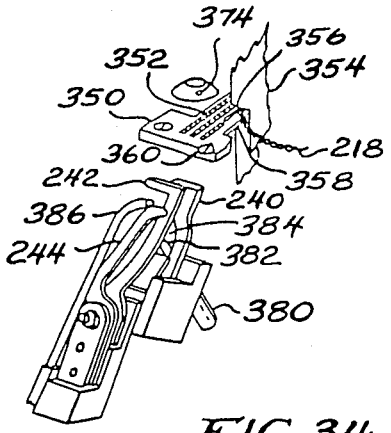
FIG.34
FIG.35
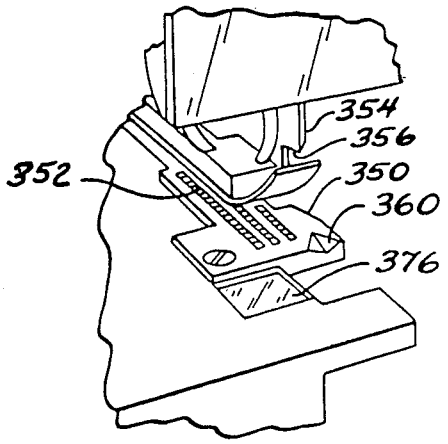
FIG.37
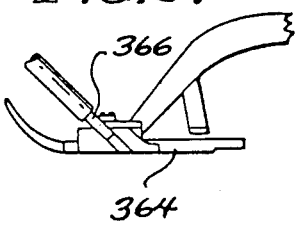
FIG.36
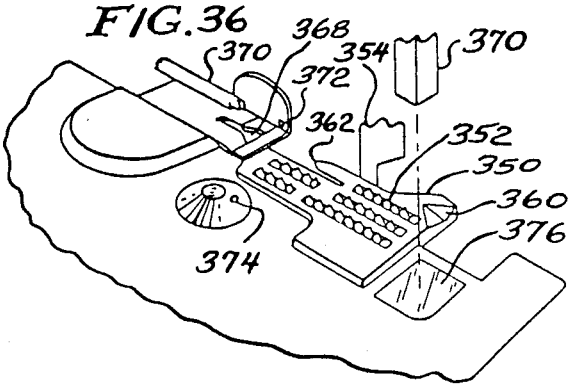

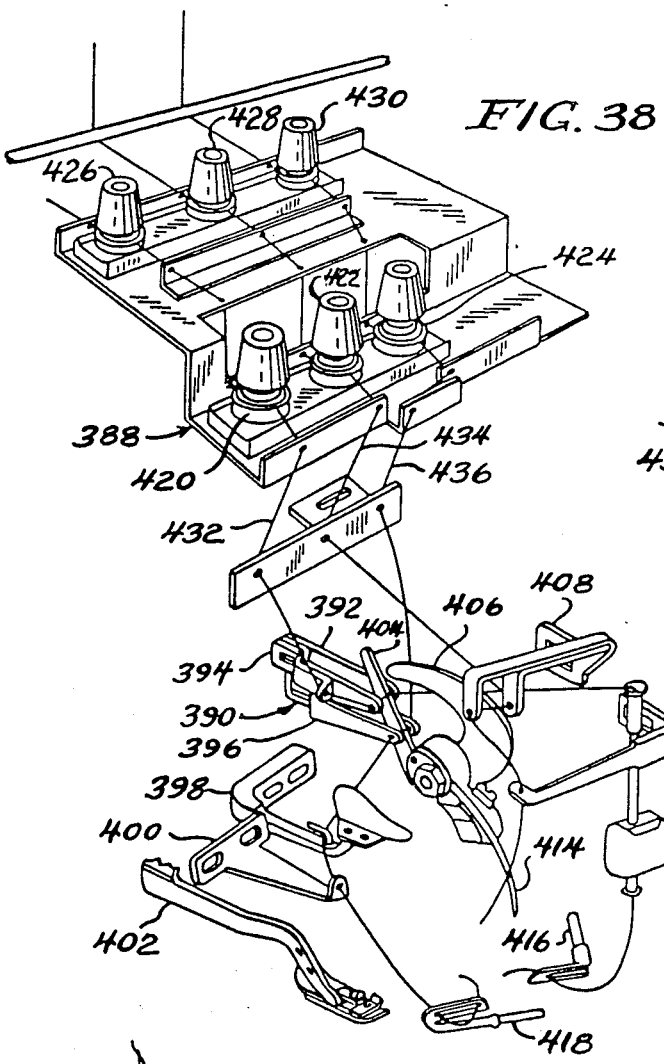
FIG. 38
FIG. 39
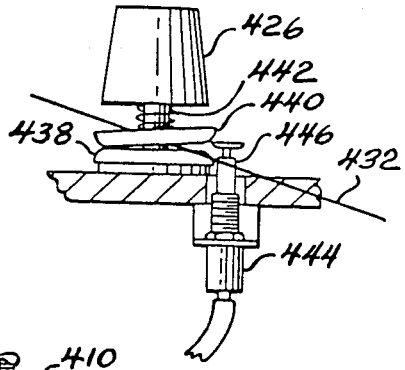
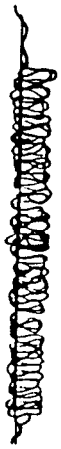
FIG. 40
FIG. 41
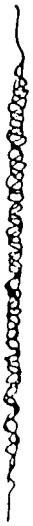

HEMMER SEAMER ASSEMBLY

CROSS-REFERENCE TO RELATED APPLICATIONS

This is a division of application Ser. No. 162,919, filed Mar. 2, 1988 now U.S. Pat. No. 4,800,830 dated Jan. 31, 1989.

The present application is related to Serial No. 050,989, filed May 18, 1987, and Ser. No. 050,360, filed May 18, 1987.

BACKGROUND OF THE INVENTION

The present invention relates to a hemmer seamer assembly.

In the past, the commercial production of shirt sleeves, particularly T-shirt sleeves has been quite labor-intensive and expensive. A sleeve blank is cut from a larger piece of cloth, and then is fed by hand to a forming station whereat a hem is formed along one edge of the blank. The hem blank is then commonly manually removed from the forming station, and folded over by hand. The sleeve handling device disclosed in U.S. Ser. No. 050,989, incorporated herein by reference, automatically forms the hem in the blank, and folds the blank for subsequent handling.

The folded blank is then passed to a sewing station to sew a seam in the folded blank in order to form the sleeve, and the sleeve may include an arcuate seam along an edge of the blank generally transverse to the hem.

However, sewing machines which form seams utilizing chain stitches on a succession of pieces of material with the seam being continued into the area intermediate the pieces of material have been used in other environments. With seams of this type, means are provided for detaching the pieces of material one from the other by appropriate automatic chain-cutting devices after the sewn pieces have been caused to travel beyond the needle and the presser foot of the machine.

By cutting the chain of stitches with these devices, one portion of minimal length remains attached to the stitched piece of material and the other being connected to the throat plate which will project from a subsequent piece of stitched material resulting in a slackening of the seams initial stitches which give the leading edge of the work piece an undesirable appearance and unsatisfactory initial stitches.

SUMMARY OF THE INVENTION

A principal feature of the present invention is the provision of an improved hemmer seamer assembly.

The hemmer seamer assembly of the present invention includes an apparatus for positioning a chain of stitches for stitching onto Fabric having a needle and a throat plate comprising, means for positioning the chain of stitches forwardly of the needle, and means for moving the fabric to the throat plate for sewing the chain onto the fabric.

A feature of the present invention is that the forwardly positioned chain is incorporated into the seam of a subsequent sewn fabric Thus, another feature of the invention is that the assembly results in a sewn sleeve of improved appearance and structural integrity.

Yet another feature of the invention is the provision of a table assembly to receive a folded cloth blank.

A further feature of the invention is the provision of means for grasping the cloth blank on the table assembly.

Another feature of the invention is the provision of means for moving the table assembly toward a transport assembly.

A further feature of the invention is that the table assembly may be moved an adjustable distance toward the transport assembly.

Still another feature of the invention is that the transport assembly includes means for clamping a portion of the cloth blank brought to the transport assembly by the table assembly.

A feature of the invention is that the table assembly may be returned to its initial position once the clamping means grasps the portion of the cloth blank in order that the table assembly may quickly receive a subsequent folded blank for improved automation of the assembly.

A further feature of the invention is that the grasping means releases the cloth blank when the clamping means grasps the portion of the cloth blank.

Another feature of the invention is that the transport assembly automatically moves the cloth blank toward the sewing machine.

A feature of the present invention is that a sensor detects a leading edge of the cloth blank when it i located in proper position adjacent the sewing machine for sewing.

Yet another feature of the invention is that the clamp means releases the cloth blank, and the transport assembly returns to its initial position to obtain a subsequent cloth blank for improved automation of the device.

Yet another feature of the invention is that the table assembly may be adjusted for proper placement of the cloth blank relative to the sensor..

Still another feature of the invention is that the sensor may be utilized to locate the cloth blank for sewing without adjustment of the table assembly.

Yet another feature of the invention is that when the sensor detects the leading edge of the cloth blank sewing of the blank is initiated.

A further feature of the invention is that transport belts are moved to an operative position to engage the cloth blank during an initial part of sewing.

In a preferred form, the assembly has an upper belt to engage against and move the cloth blank during sewing.

Another feature of the invention is that after a short time of sewing the transport belts are moved to a position in disengagement from the cloth blank to permit the transport assembly to bring another cloth blank toward the sewing machine.

A further feature of the invention is the provision of means for automatically selectively turning the cloth blank during sewing to produce to a curved line of sewing along an arcuate edge of the blank.

Yet another feature of the invention is that the cloth blank may be automatically selectively turned by the assembly in accordance with different curves and widths of the blanks.

A further feature of the invention is that the blank may include a straight line of stitching before the blank is turned to produce the curved line of stitching.

A feature of the present invention is that a second sensor detects a trailing edge of the blank or sleeve after the blank has been sewn.

Another feature of the invention is that the upper and lower belts, in addition to the sewing machine, are stopped when the second sensor detects the trailing edge of the sleeve.

In a preferred form, the assembly has a clamp which retains the material against a support plate at this time in order to prevent movement of the material.

A feature of the present invention is that the assembly actuates a forward chain gripping apparatus when the second sensor detects the trailing edge of the garment.

A further feature of the invention is that the sewing machine blows the chain off of a stitch tongue, severs the chain, and positions the chain forwardly of the needle where it is grasped by the gripping apparatus.

Another feature of the invention is that the upper belt is raised to permit passage of the chain to the position forwardly of the needle.

Yet another feature of the invention is that the clamp releases the fabric from the support plate, and the upper belt is lowered onto the sewn sleeve.

Still another feature of the invention is that the assembly automatically stops movement of the transport assembly in the event that it moves a subsequent blank cloth prior to completion of the sewing of the previous blank.

A further feature of the invention is that the lower belts are disengaged from the cloth blank to permit the transport assembly to move a subsequent cloth blank as close as possible to the sewing machine during sewing of a previous blank for improved automation of the device.

Another feature of the invention is that the sewn sleeve is moved away from the sewing machine upon initiation of the sewing machine for sewing the subsequent blank.

Yet another feature of the invention is the provision of means for automatically aligning a turned sleeve to a straightened configuration to permit automatic stacking of the sleeves.

Still another feature of the invention is that the alignment device may be adjusted to permit straightening of the sleeves a variable amount.

Further features will become more fully apparent in the following description of the embodiments of this invention and from the appended claims.

DESCRIPTION OF THE DRAWINGS

In the drawings:

FIG. 11 is a fragmentary elevational view showing the device of FIG. 1 transporting a cloth or fabric to a second conveyor;

FIG. 12 is a fragmentary elevational view of the device of FIG. 1 showing the dropping of the cloth onto the second conveyor of the device of FIG. 1;

FIG. 13 is a fragmentary sectional view taken substantially as indicated along the line 13—13 of FIG. 11;

FIGS. 26–30 are fragmentary perspective views showing operation of the gripping apparatus of FIGS. 19–25;

FIG. 31 is a fragmentary plan view of a fabric stitched with the sewing machine;

FIG. 32 is a fragmentary plan view of a fabric stitched with the sewing machine;

FIG. 33 is a fragmentary perspective view of the sewing machine with a chain of stitches being grasped forwardly of a needle of the machine;

FIG. 34 is a fragmentary perspective view of the machine of FIG. 33 showing the chain being released and moved into the path of a cutting device;

FIG. 35 is a fragmentary perspective view of a presser foot and throat plate of the sewing machine of FIG. 33;

FIG. 36 is a fragmentary perspective view of a vacuum and blower arrangement for the sewing machine of FIG. 33;

FIG. 37 is a sectional view of a presser foot of the sewing machine;

FIG. 38 is a perspective view of a tensioning device and stitch forming instrumentality for the sewing machine of FIG. 33;

FIG. 39 is an elevational view of an actuatable tensioning means for the tensioning device of FIG. 38;

FIG. 40 is a plan view of overedge stitches which are sewn into the fabric;

FIG. 41 is a plan view of a chain of stitches which are formed on a trailing edge of the fabric;

DESCRIPTION OF THE PREFERRED EMBODIMENTS

Figure 1:
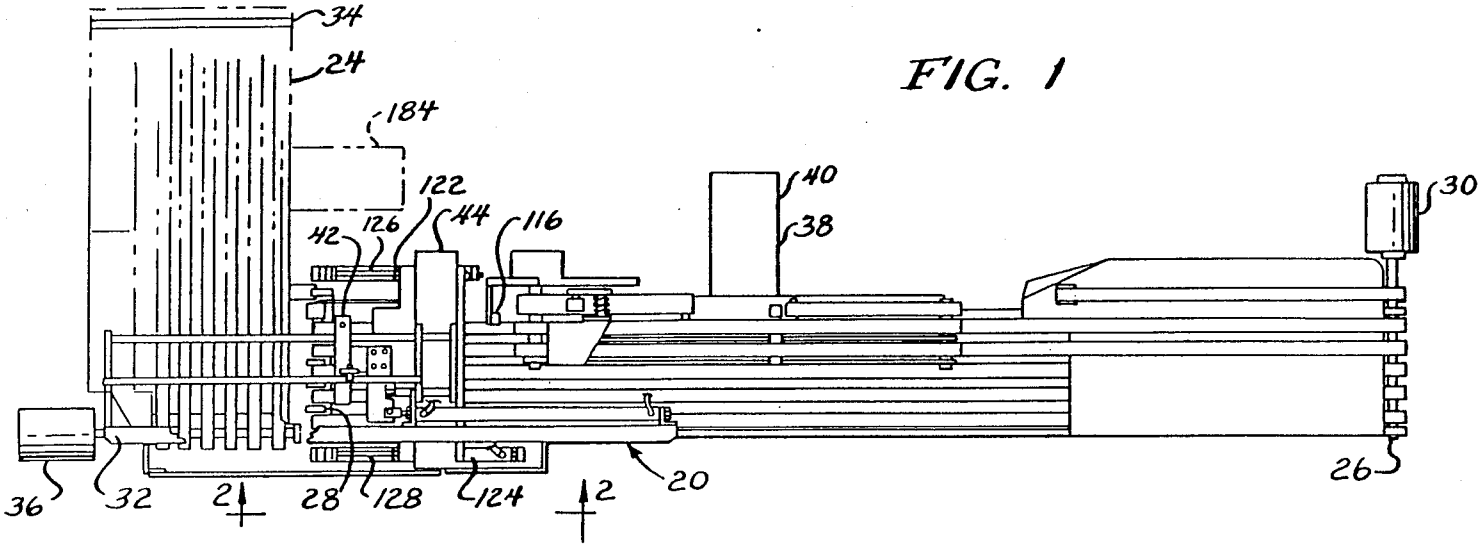
FIG. 1 is a top plan view of cloth handling device.
Figures 2, 3:
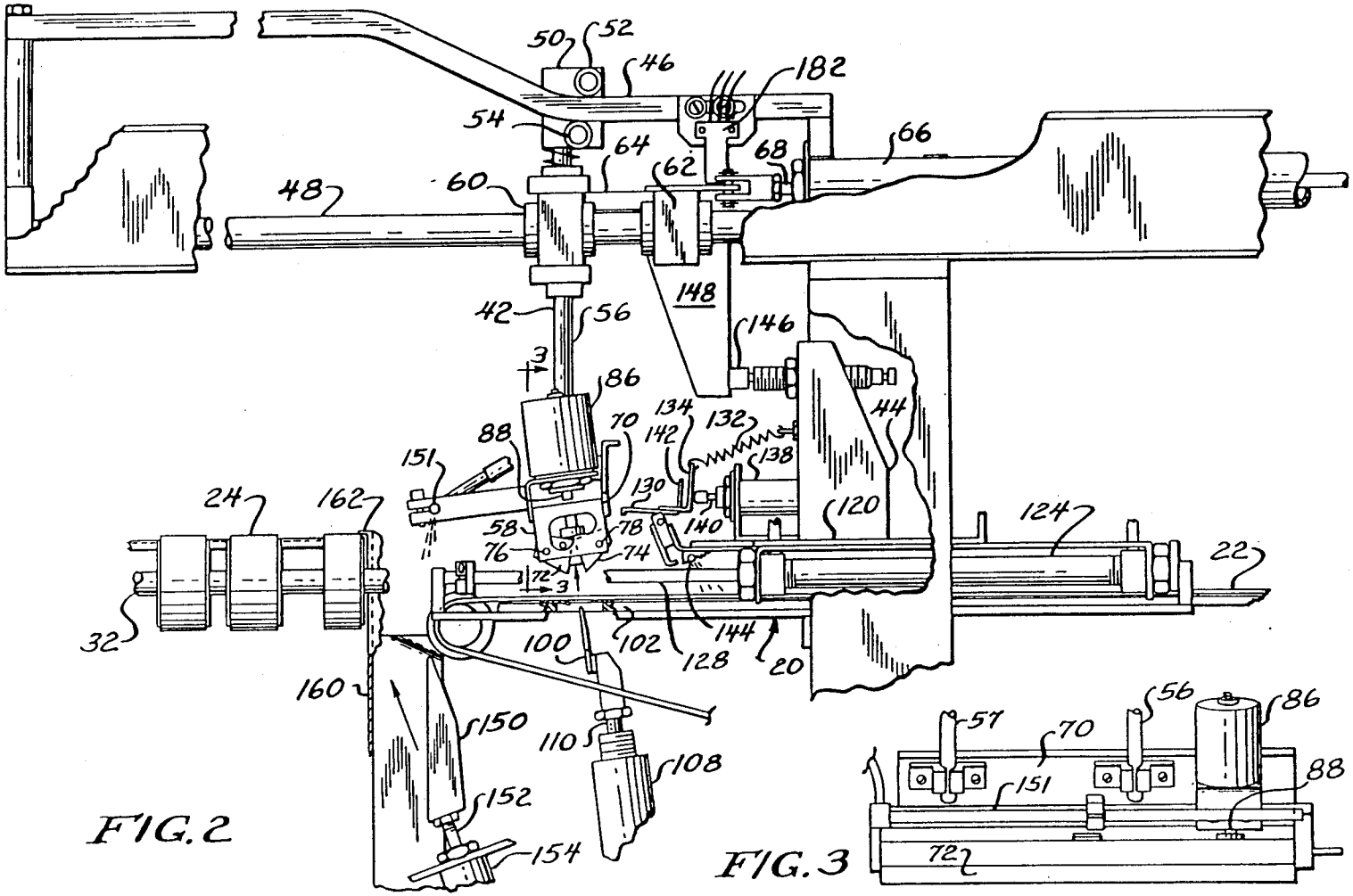
FIG. 2 is a fragmentary side elevational view of the device taken substantially as indicated along the line 2—2 of FIG. 1.
FIG. 3 is a fragmentary elevational view taken substantially as indicated along the line 3—3 of FIG. 2.

Referring now to FIGS. 1 and 2, there is shown a sleeve handling device generally designated 20 having a first conveyor 22, and a second conveyor 24 disposed generally at right angles to the first conveyor 22, which will be further described in modified form below. The first conveyor 22 is disposed about a pair of spaced rotatable rollers 26 and 28, and the first conveyor 22 is driven by suitable means, such as a motor 30 operatively connected to the roller 26. The second conveyor 24 is disposed about a pair of spaced rotatable rollers 32 and 34, and the second conveyor 24 is driven by suitable means, such as a motor 36 operatively connected to the roller 32.

Figure 15:
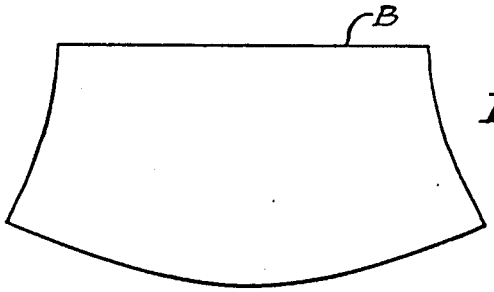
FIG. 15 is a plan view of a sleeve blank or cloth which is utilized in the device of FIG. 1.
Figure 16:
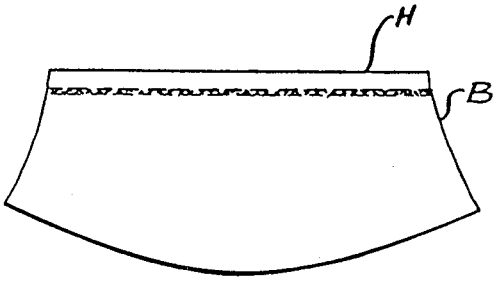
FIG. 16 is a plan view of the blank of FIG. 15 with a sewn hem.

With reference to FIG. 15, cloth or fabric sleeve blanks B are placed on the first conveyor 22 adjacent the roller 26, and the blanks B pass through a hemming station 38 including a sewing machine 40 for forming a hem H in the blanks B, as shown in FIG. 16. The hemming station 38 is of conventional nature, and does not form part of the present invention.

With reference to FIGS. 1 and 2, the sleeve handling device 20 has a cloth pickup device 42 and a carriage 44. The device 20 has an elongated bar 46 which is tapered upwardly from a location above the first conveyor 22 to a location above the second conveyor 24, with the second conveyor 24 being preferably located at a higher elevation than the first conveyor 22. The device 20 also has an elongated rod 48 which extends from a location above the first conveyor 22 past the second conveyor 24.

The cloth pickup device 42 has a housing 50 with a pair of spaced lower and upper rollers 52 and 54 which bear upon the bar 46, and permit movement of the pickup device 42 along the bar 46. The pickup device 42 has an elongated rod 56 connected to the housing 50 and supporting a jaw assembly 58. The pickup device 42 has a first bushing 60 slidably received on the rod 48, and the rod 56 is slidably received in the first bushing 60. The pickup device also has a second rod 57 supporting the jaw assembly 58. The pickup device 42 has a second bushing 62 connected to the first bushing 60 by a plate 64, with the second bushing 62 being slidably received on the rod 48. The pickup device 42 has a cylinder 66 with a piston 68 connected to the plate 64 which is controlled by the central processing unit 118 of FIG. 18. The cylinder 66 moves the pickup device 42 through the piston 68 from a first home position above the first conveyor 22, as shown in FIG. 2, to a second remote position, as shown in FIG. 12, above the second conveyor 24. During movement of the pickup device 42 from the first position to the second position, the housing 50, in addition to the rod 56 and jaw assembly 58, is raised by the bar 46 above the second conveyor 24 which is located at a higher position than the first conveyor 22. During movement of the pickup device 42 from the first to second position, the rod 56 slides in the first bushing 60 in order to raise the jaw assembly 58 above the second conveyor 24.

Figure 6:
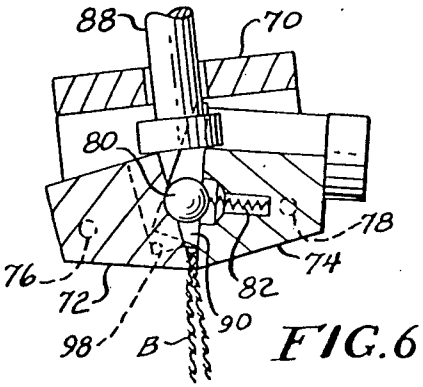
FIG. 6 is a fragmentary sectional view of the device of FIG. 4 showing the jaws in a closed position.
Figure 5:
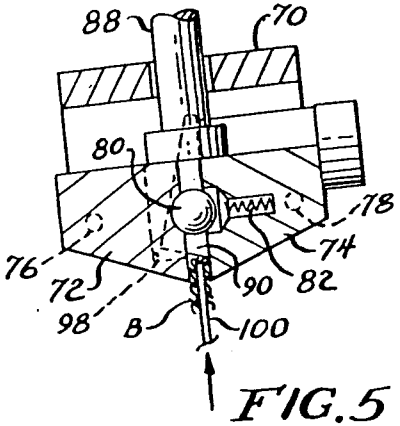
FIG. 5 is a fragmentary sectional view of the device of FIG. 4 showing the jaws in an intermediate position.
Figure 4:
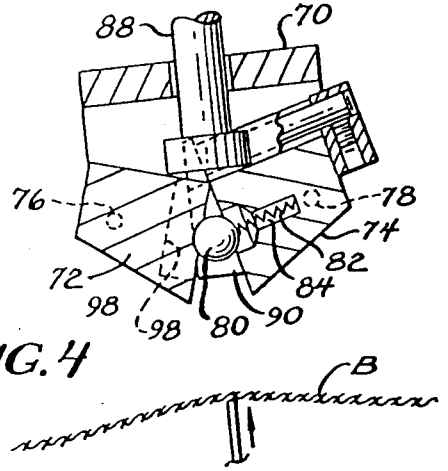
FIG. 4 is a fragmentary sectional view of a cloth pickup device showing jaws of the device in an open position.

With reference to FIGS. 2–6, the jaw assembly 58 has an elongated housing 70 pivotally supporting first and second elongated tapered jaws 72 and 74 by a pair of respective pins 76 and 78. The jaws 72 and 74 are pivotally mounted by the pins 76 and 78 about first and second parallel axes such that the jaws are pivotable between a first position, as shown in FIG. 6, wherein they are in operative clamping position with respect to each other to clamp a piece of cloth therebetween, and a second open position, as shown in FIG. 4, in order to allow a piece of cloth to freely pass into a position between the jaws 72 and 74. The jaw assembly 58 has a ball 80 disposed between the jaws 72 and 74, and a helical spring 82 received in a recess 84 of the second jaw 74, such that the spring 82 biases the ball 80 from the second jaw 74 toward the first jaw 72. The spring 82 and ball 80 act directly upon the jaws 72 and 74 in order to maintain the jaws 72 and 74 in either of the first or second position as shown in FIGS. 6 and 4, once the jaws 72 and 74 are moved to that position from an intermediate position, as shown in FIG. 5.

The pickup device 42 has a cylinder 86 with a movable piston 88 which engages against the jaws 72 and 74. With the jaws in the first closed configuration, as shown in FIG. 6, the cylinder 86 may be actuated by the central processing unit 118 of FIG. 18 in order to drive the piston 88 against the jaws 72 and 74, and move the jaws 72 and 74 to the second open position, as shown in FIG. 4.

With reference to FIGS. 2–6 and 8, the jaw assembly 58 has an elongated plate 90 pivotally mounted on the jaw 74 by a pin 92. The plate 90 has a pair of opposed depending plate sections 94 and 96 disposed over a front surface of the second jaw 74. The plate 90 is received in a recess 98 of the first jaw 72 when the jaws 72 and 74 are moved from the open configuration, as shown in FIG. 4, to the closed configuration, as shown in FIG. 6.

With reference to FIGS. 1–6, and 8–10, the device 20 has an elongated actuating member 100 disposed beneath a bed 102 of the first conveyor 22. The actuating member 100 has a plurality of upwardly directed blades 104*a*, 104*b*, 104*c*, 104*d*, and 104*e* extending upwardly from a connecting portion 106. The device 20 has a cylinder 108 which moves a piston 110 connected to the actuating member 100. The blades 104*a* to 104*e* are aligned with openings 112*a*, 112*b*, 112*c*, 112*d*, and 112*e* in the bed 102, and the blades 104*b* and 104*d* of the actuating member 100 are aligned with the plate sections 94 and 96 of the plate 90. As shown, the blades 104*a*, 104*c*, and 104*e* have upwardly directed spaced pointed members 114. The cylinder 108 is controlled by the central processing unit 118 of FIG. 18 and moves the actuating member 110 between a first position with the blades 104*a* to *e* beneath the bed 102 to a second position with the blades or fingers 104*a* to *e* passing through the openings 112*a* to *e* into a configuration above the bed 102 where the blades 104*b* and 104*d* engage against the plate sections 94 and 96 of the plate 90 and move the jaws 72 and 74 to their closed configuration, as shown in FIG. 6, after which the actuating member 100 is retracted to the first lower position beneath the bed 102. During movement of the actuating member 100 from the first lower position to the second upper position, the pointed members 114 engage against the cloth in order to more positively retain and move the cloth between the open jaws 72 and 74. The plate 90 is pivotally mounted in the jaw assembly 58 in order to take up tolerances during actuation by the fingers 104*b* and 104*d* of the actuating member 100.

With regard to FIG. 1, when the hemmed blank B of cloth as shown in FIG. 16 passes from the hemming station 38, the hemmed blank B passes beneath a photosensor 116. The photosensor 116 senses the leading and trailing edge of the hemmed blank B as it passes beneath the photosensor 116, and provides this information to the central processing unit 118 of FIG. 18. The central processing unit 118 determines the length of the cloth blank B based upon the information provided by the photosensor 116 as determined by the time between sensing the leading and trailing edges of the blank B, and by knowing the speed of the first conveyor 22. Thus, the photosensor 116 and central processing unit 118 determines the length of the blank B. The central processing unit 118 also knows the distance from the photosensor 116 to the actuating member 100, and the actuation time required to move the actuating member 100 from the first lower position to the second upper position. Thus, the central processing unit 118 calculates the time at which the lateral central portion of the cloth blank B is located shortly before the actuation member, and the central processing unit 118 actuates the cylinder 108 to move the actuating member through the bed 102 against the cloth blank B where the pointed members 114 of the blades 104*e, c,* and *e* catch the cloth blank B and move it upwardly between the jaws 72 and 74 while the blades 104*b* and 104*d* of the actuating member 100 strike the plate 90 and close the jaws 72 and 74 which capture the lateral central portion of the cloth blank B after which the actuating member 100 retracts to it slower position beneath the bed 102. In this manner, the pickup device 42 captures the lateral central portion of the cloth blank B irrespective of the length of the cloth blank B passing through the hemming station 18.

In this manner, the pickup device 42 captures the cloth blank B in the lateral central portion with improved accuracy since the pickup device 42 is at a stationary position and the actuating member 100 moves the cloth blank B between the jaws 72 and 74 and closes the jaw with precision irrespective of the length of the cloth blank B. In addition, the pickup device 42 and actuating member 100 results in an improved pickup of the cloth blank B, and results in a more uniform and deeper grab of the cloth blank B between the jaws 72 and 74. Further, the pickup device 42 of the present invention results in a more reliable pickup of the cloth blank B, and results in a more accurate dropping of the cloth blank B on the second conveyor 24, as will further be described below.

Figure 7:
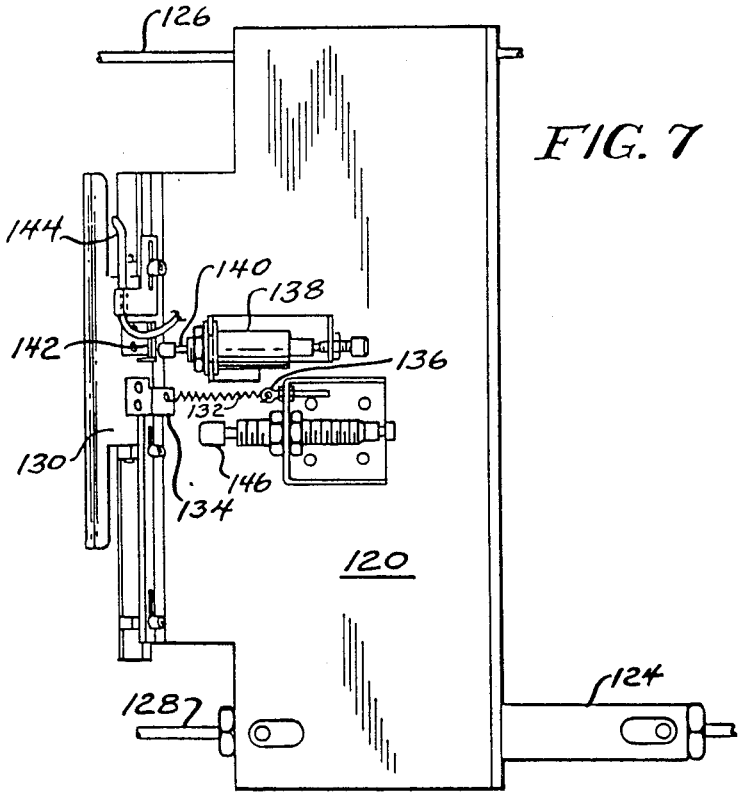
FIG. 7 is a top plan view of a carriage for the device of FIG. 1.
Figure 8:
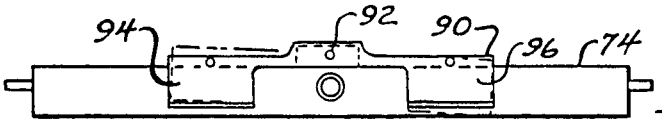
FIG. 8 is a side elevational view of one of the jaws of the device of FIG. 4.
Figure 9:
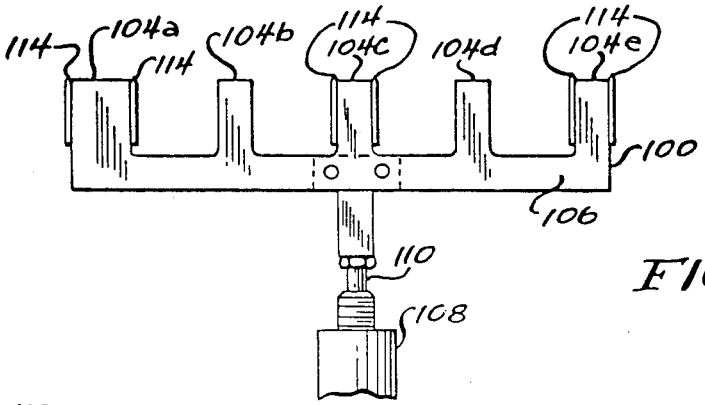
FIG. 9 is a fragmentary elevational view of an actuating device for the jaws in the device of FIG. 4.
Figure 10:
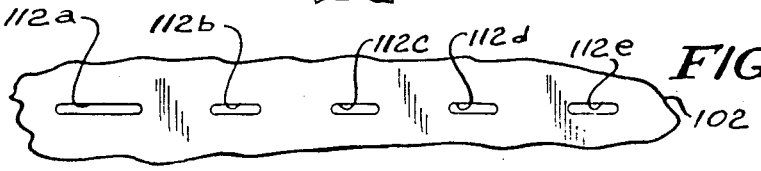
FIG. 10 is a fragmentary plan view of a portion of the bed in a first conveyor of the device of FIG. 1.
Figure 18:
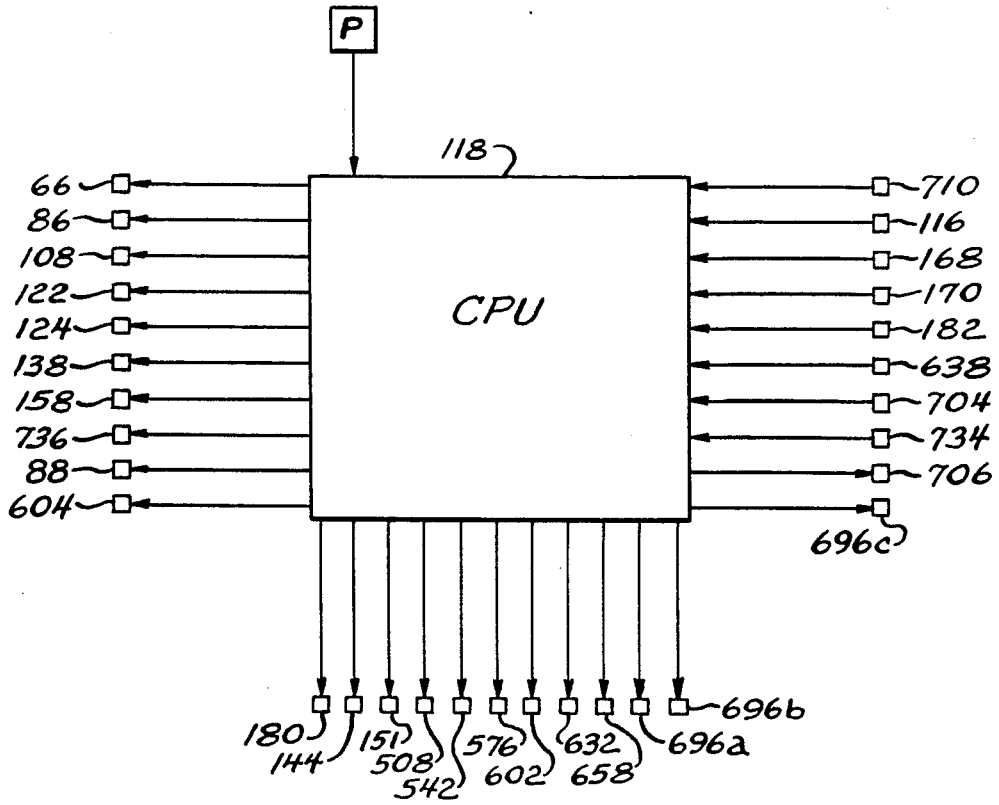
FIG. 18 is a diagrammatic view illustrating operation of a central processing unit of the device.

With reference to FIGS. 1, 2, and 7, the carriage 44 located adjacent the cloth pickup device 42 has an elongated plate 120 which is secured to a pair of cylinders 122 and 124 which move along a pair of respective rods 126 and 128, with the cylinders 122 and 124 being actuated by the central processing unit 118 of FIG. 18. The cylinders 122 and 124 move the carriage 44 from a first home position, as shown in FIGS. 1 and 2 to a second remote position, as shown in FIG. 12. The carriage 44 has a forward clamp member 130 pivotally mounted on the forward portion of the carriage 44. The carriage 44 has a helical spring 132 connected between a flange 134 on the clamp member 130 and a fixed pin 136, such that the spring 132 normally biases the clamp member 130 into an upper position. The carriage 44 has a cylinder 138 actuated by the central processing unit 118 of FIG. 18 with a movable piston 140 which engages against a flange 142 on the clamp member 130. When the cylinder 138 is actuated, the piston moves the flange 142 and clamp member 130 to a lower clamping position against the bias of the spring 132. The carriage 44 also has an elongated tube 144 which serves as a blower for a purpose which will be described below. The carriage 44 has a central bumper 146 which engages against a depending flange 148 of the pickup device 42 when the pickup device 42 and carriage 44 are returned to the first home position.

Figure 14:
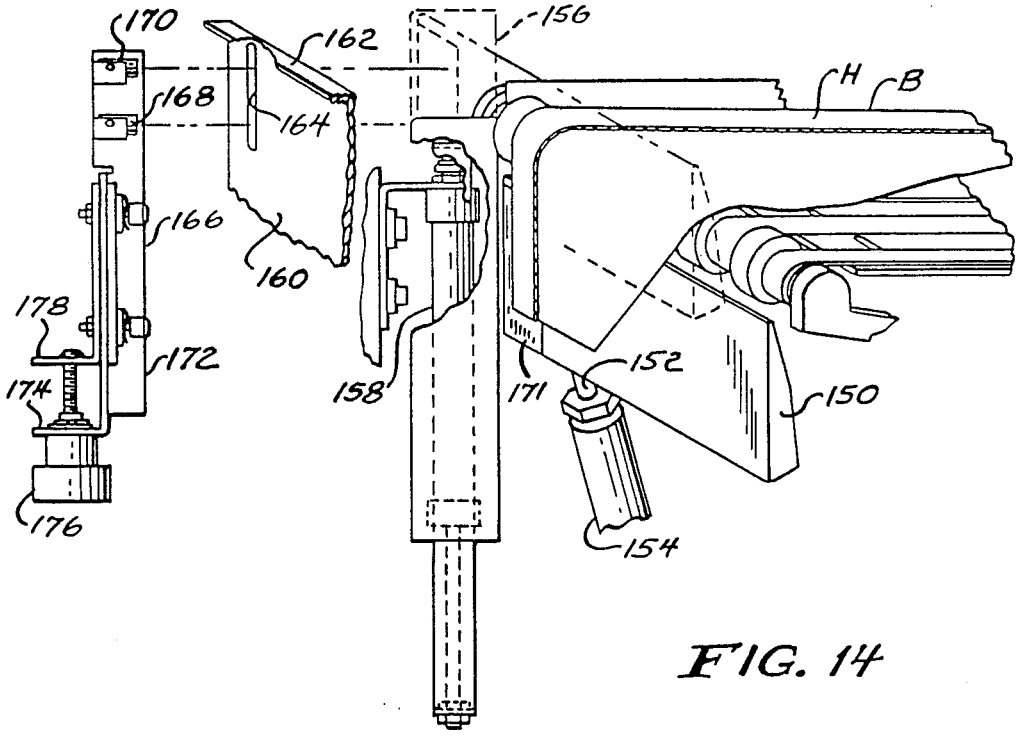
FIG. 14 is a fragmentary exploded view of a portion the device of FIG. 1 near an end of the first conveyor.

With reference to FIG. 14, prior to pickup of the cloth blank B by the pickup device 42, the leading edge of the blank B passes around the forward end of the first conveyor 22 and over a side of an elongated tapered lower hem guide 150, while a blower 151 of the pickup device passes air against the blank B as actuated by the central processing unit 118. The hem guide 150 is connected to a piston 152 extending from a cylinder 154 which is actuated by the central processing unit 118 of FIG. 18. As will further be discussed below, the lower hem guide 150 is moved between a first lower position as shown in solid lines to a second upper position shown in phantom lines.

With reference to FIG. 14, the sleeve handling device 20 has an elongated edge guide 156 which is connected to a cylinder 158 which is controlled by the central processing unit 118 of FIG. 18. The cylinder 158 moves the edge guide 156 between a first lower position beneath the top of the first conveyor 22 to a location above the first conveyor 22.

With further reference to FIG. 14, the device 20 has an elongated plate 160 located adjacent the second conveyor 24 and having an upper outwardly directed flange 162. As shown, the plate 160 has an elongated vertical slot 164 extending through the plate 160.

The device 20 has a sensor unit 166 mounted on an elongated plate 172 adjacent the plate 160 with a first lower sensor 168 and a second upper sensor 170 aligned with the slot 164 of the plate 160, with the sensors 168 and 170 being aligned with a reflective surface 171 of the lower hem guide 150. The plate 172 is connected to an outwardly directed lower flange 174. The sensor unit 166 has a threaded adjustment member 176 passing through openings of the flange 174 and a flange 178 of the sensor unit 166. Through movement of the adjustment member 176 the heights of the plate 172 and the corresponding first and second sensors 168 and 170 may be vertically adjusted relative to the slot 164 of the plate 160 for a purpose which will be described below. With reference to FIGS. 11 and 13, the device 20 has a tube 180 adjacent the plate 160 which serves as a second blower.

After the cloth blank B has been picked up by the pickup device 42 the central processing unit 118 actuates the cylinder 158 in order to raise the edge guide 156 to a location above the first conveyor 22. The central processing unit 118 also actuates the blowers 144 and 180 at this time. The central processing unit 118 actuates the cylinder 66 in order to move the pickup device 42 toward its second position above the second conveyor 24, and simultaneously actuates the cylinders 122 and 124 to move the carriage 44 from the home position toward the second remote position alongside the pickup device 42. After the pickup device 42 begins to move toward its second position, the central processing unit 118 actuates cylinder 154 in order to move the lower hem guide 150 from its first lower position to its second upper position to a location between the two plies of the picked up cloth blank B while the lower blower 180 and upper blower 144 blow against the lower and upper plies of the cloth blank B in order to cause registration of the blank B against the edge guide 156. In this manner, the pickup device 42 and carriage 44 are moved toward the second remote position, as shown in FIG. 11. When the trailing edge of the cloth blank B uncovers the lower sensor 168 of the sensor unit 166, the central processing unit 118 turns off the blowers 144 and 180 and actuates the cylinder 158 in order to lower the edge guide 156. At this time, the pickup device 42 and carriage 44 move a little distance further toward the second position, as shown in FIG. 12, and the trailing edge of the cloth blank B uncovers the second upper sensor 170 as determined by the central processing unit 118. As a result, the central processing unit 118 actuates the cylinder 138 of the carriage 44 in order to lower the clamp member 130 against the flange 162 of the plate 160 in order to clamp the trailing edge of the cloth blank B therebetween, and ascertain that the folded blank B will be located correctly on the second conveyor 24. At approximately the same time, the central processing unit 118 actuates the cylinder 86 of the pickup device 42 in order to open the jaws 72 and 74 of the jaw assembly 58, and release the cloth blank B onto the second conveyor 24. Shortly thereafter, the central processing unit 118 actuates the cylinder 138 in order to retract the piston 140, such that the spring 132 returns the clamp 130 to its upper position spaced from the flange 162 of the plate 160 in order to release the cloth blank B on the second conveyor 24.

Figure 17:
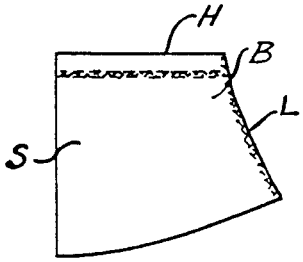
FIG. 17 is a plan view of the blank as sewn into the configuration of the sleeve.

After the cloth blank B has been placed on the second conveyor 24, the central processing unit 118 actuates the cylinder 154 in order to lower the lower hem guide 150 to its first lower position. At the same time, the central processing unit 118 actuates the cylinder 66 of the pickup device 42 and the cylinders 122 and 124 of the carriage 44 in order to return the pickup device 42 and carriage 44 toward its home position. The device 20 has a metal detector 182 mounted on the bar 46, and senses through the central processing unit 118 when the pickup device 42 and carriage 44 are returned to their first home position for subsequent operation of the actuating member 10 on a subsequent cloth blank B. With reference to FIGS. 1, 12, and 17, the folded cloth blank B placed on the second conveyor 24 has a central fold F and moves toward a sewing station 184 where the cloth blank B is trimmed and sewn along a line L of sewing into the configuration of a sleeve S, as shown in FIG. 17, which will be further discussed below.

With reference to FIG. 14, as previously discussed, the height of the first and second sensors 168 and 170 may be adjusted by the adjustment member 176 relative to the slot 164 of the plate 160. Through adjustment of the sensors 168 and 170, the amount of trim in the sewing station 184 of FIG. 1 is controlled, such that if the sensors 168 and 170 are lowered relative to the slot 164, the sleeve blank B is trimmed an additional amount by the sewing station 184. In an ideal situation, the sensors 168 and 170 are moved to the maximum vertical position 184 in order to minimize the amount of trim in the sewing station 184. However, the sensors 168 and 170 may be moved to a lowermost position, and the central processing unit 118 may introduce a time delay to modify the drop off time after the trailing edge of the cloth blank B is uncovered by the sensors 168 and 170.

As a general construction and operation of a sewing machine, which may be of Federal Stitch Type 504, to which the present description is applicable, is well known and familiar to those conversant in the art, and as the invention is primarily concerned with a device for positioning and gripping a chain of stitches for incorporation into the initial stitches of a new seam, it is only considered necessary here to illustrate and describe those parts which are directly concerned with a preferred form of the invention. The sewing machine described as follows, which may be termed a latch tacker is utilized in the sewing station 184 described in connection with FIG. 1.

Figure 19:
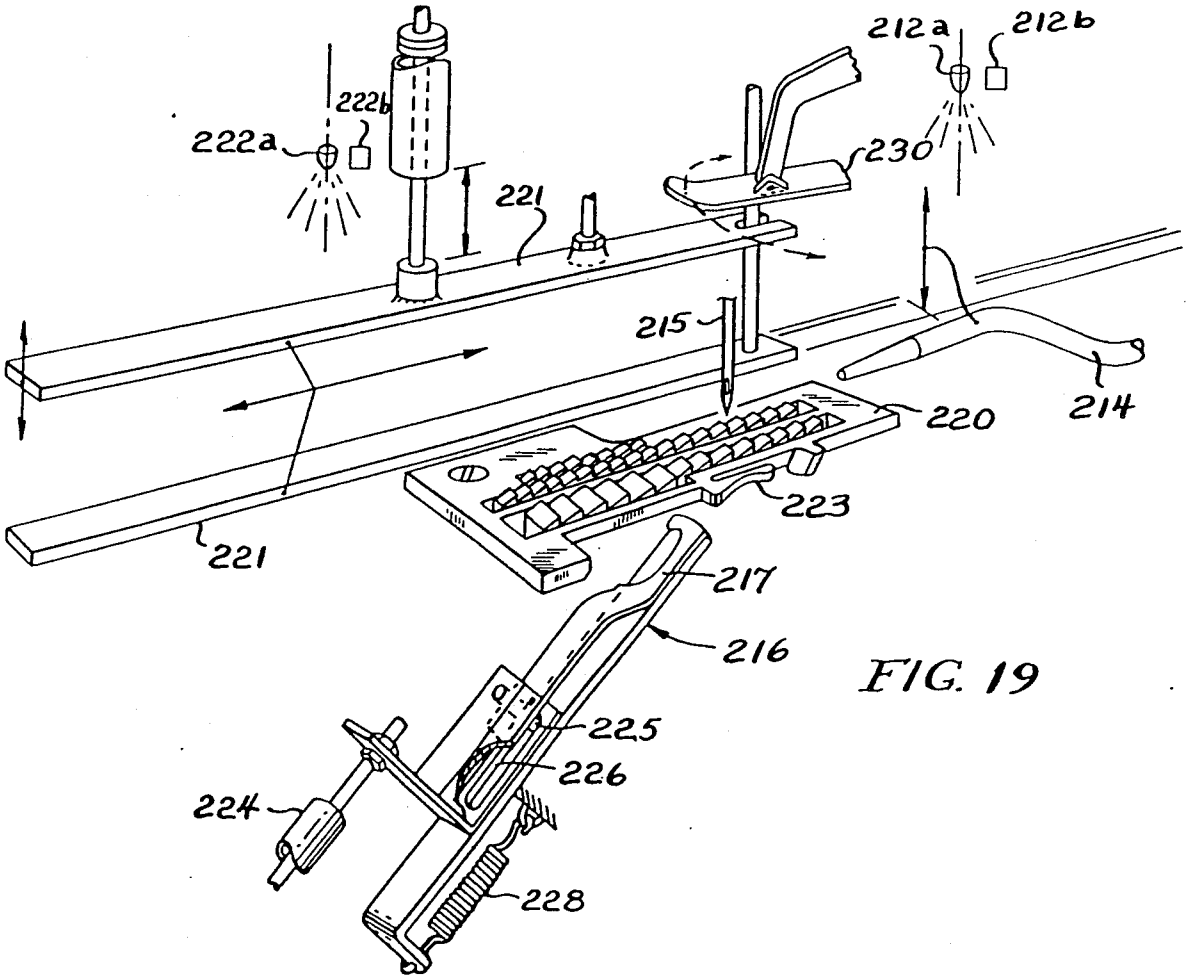
FIG. 19 is a schematic perspective view of an embodiment of a sewing machine.
Figure 20:
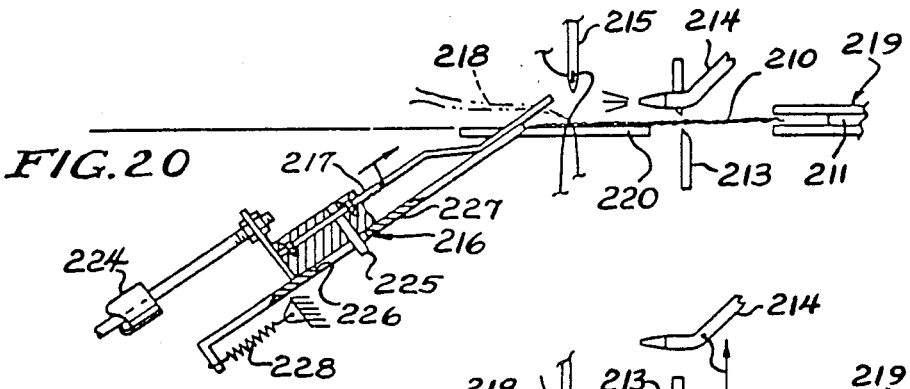
FIGS. 20–23 illustrate the cycle of operation of the machine of FIG. 19.

As shown in FIGS. 19 and 20, after the chain 210 is sewn onto the material 211, the clamp 221 moves away from the needle 215 and presser foot 230 and pulls the threads off the stitch finger or tongue 223. Light is emitted by light emitter **212*a*, and light detector 212*b* senses a change of reflectivity from a lower surface, such that the detector 212*b* senses the end of the material in response to which the cutter 213 severs the chain 210. The positioning means, in the form of a blower 214, directs a stream of air onto the severed chain to blow it back forwardly of the needle 215, as shown by the phantom chain 218. Alternatively, the machine may have a plurality of blowers to sequentially move the chain forwardly of the needle. The gripping means or apparatus 216 is activated, and the hook member 217 rises to hook around the severed chain 218**.

Figure 21:
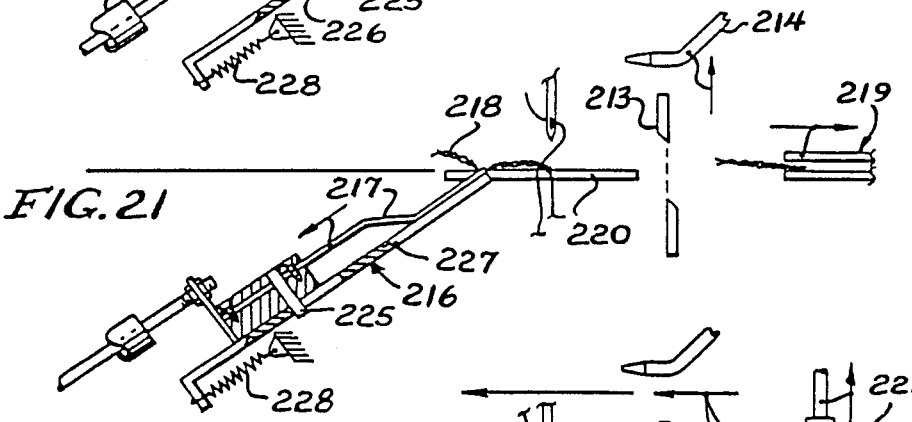

As shown in FIG. 21, the cutter 213 opens with the material feed mechanism 219 moving the sewn material to a conveyor (not shown).

The blower 214 shuts off and is raised. The hook member 217 returns to below the throat plate 220, clamping the severed chain in the gripping means 216.

Figure 22:
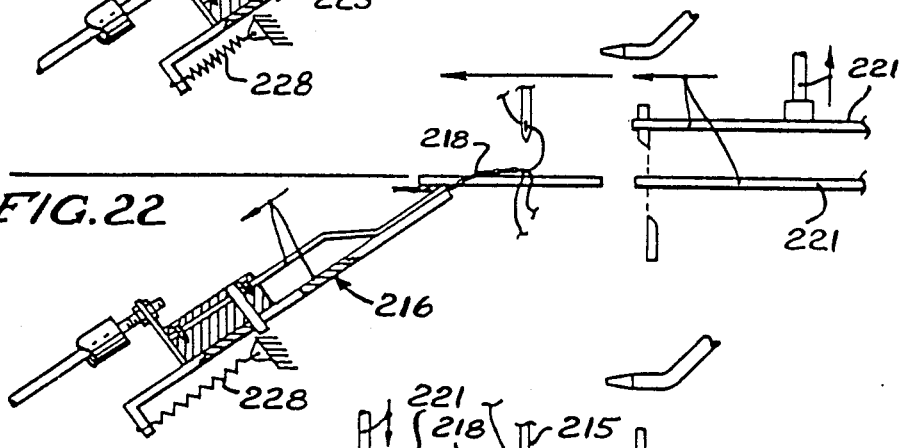
Figure 23:
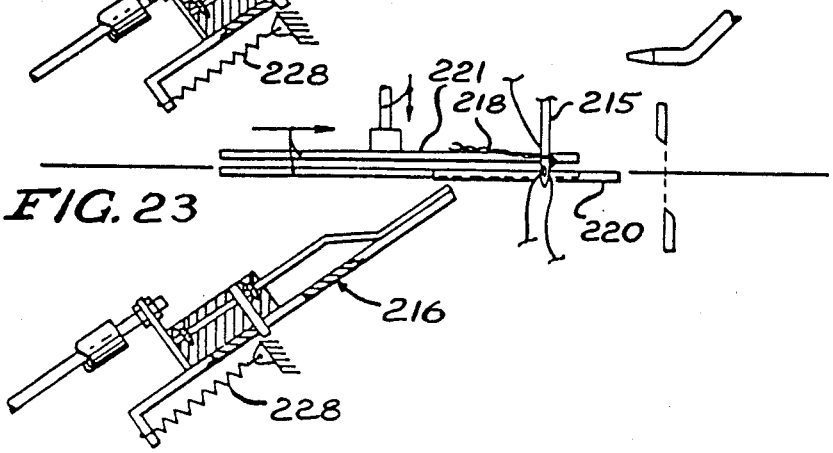

As shown in FIG. 22, the clamp 221 opens, and the released garment is removed by the conveyor, with the clamp 221 returning to its starting position forwardly of the needle 215. Meanwhile, the gripping means 216 moves further below the throat plate 220, tensioning the chain 218. Light is emitted by light emitter **222*a*, and light detector 222*b* senses a change of reflectivity from a lower surface. When material is sensed by the detector 222*b*, the clamp 221 closes and the material is fed to the sewing machine, while the chain 218 is held in tension by the gripping means 216** for the initial stitching of the seam, to prevent slackening of the seam's initial stitches which would give the leading edge of the material an undesirable appearance.

As the material 211 is moved across under the needle 215 by the material feed mechanism 219, the end of the chain is pulled from the gripping means 216 and the chain 218 is sewn into the seam, and the cycle is repeated. The resulting sewn fabric is shown in FIG. 31 in which the chain 218 is shown beneath the seaming or overedge stitches 229.

The gripping means 216 is operated by a single pneumatic cylinder 224 which is directly connected to the hook member 217. When the piston of the cylinder 224 pushes the hook member 217 upwardly, as shown in FIG. 20, an extension 225 slides in a slot 226 of member 227 of the gripping means. Upon the hook member 217 being withdrawn, as shown in FIG. 21, the extension 225 slides in the slot 226 to then abut against the member 227, whereby both the member 227 and the hook member 217 are withdrawn further below the throat plate 20 against the biasing force of the spring 228, as shown in FIG. 22. Upon the hook member 217 starting its upward motion, the spring 228 returns the member 227 to its initial position below the throat plate 220.

Thus, the present sewing machine, at all times, provides an apparatus for the cutting and the positioning of a chain stitch which ameliorates the problems of the prior art, by providing a mechanical gripping means 216 which holds the severed chain below the level of the throat plate, with the gripping means 216 being movable between position below and above the throat plate 220.

In an alternative form, the light emitter 212*a* and light detector 212*b* may be omitted, and a time delay may be initiated or stitches may be counted after light detector 222*b* senses the material in order to activate the cutter 213.

Figure 24:
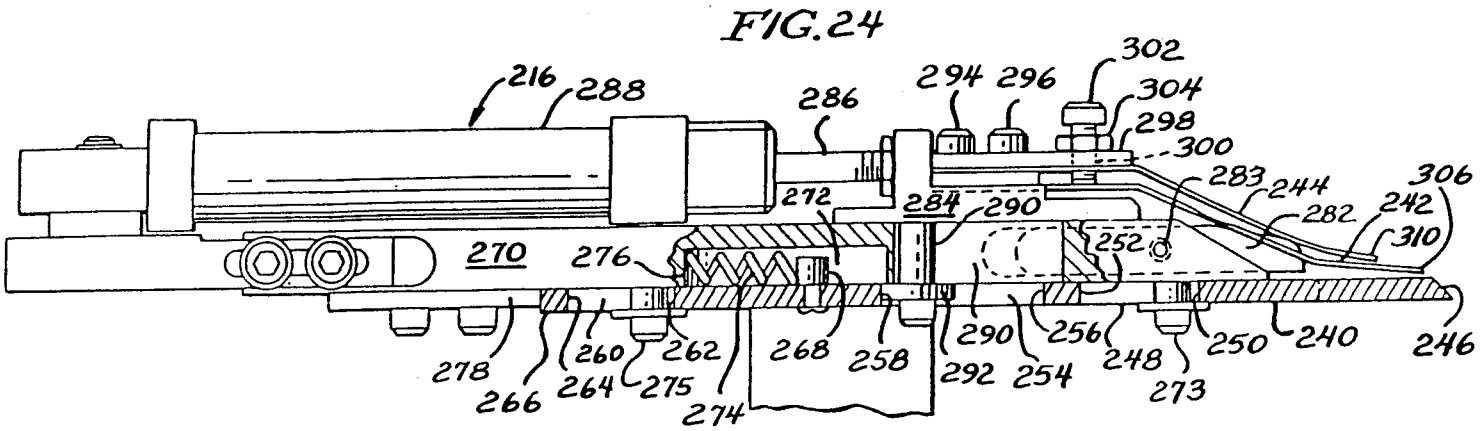
FIG. 24 is a side elevational view, partly broken away, of another embodiment of gripping apparatus for the sewing machine of FIG. 19.
Figure 25:
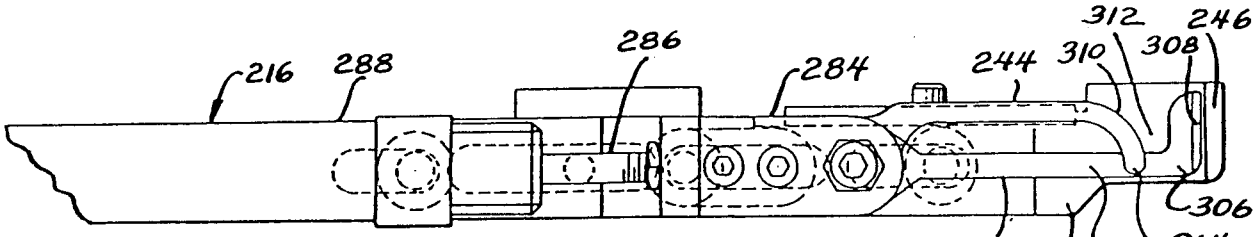
FIG. 25 is a fragmentary top plan view of the gripping apparatus of FIG. 24.

Another embodiment of the gripping apparatus 216 is shown in FIGS. 24–30. With reference to FIGS. 24–26, the gripping apparatus 216 has an elongated lower plate 240, an elongated nipper 242, and an elongated guide 244.

The plate 240 has a forward beveled edge 246, a first elongated slot 248 with opposed first and second ends 250 and 252, a second elongated slot 254 with first and second ends 256 and 258, and an elongated third slot 260 with first and second ends 262 and 264. The plate 240 also has a rearward end 266. The plate 240 has an upwardly directed pin 268 for a purpose which will be described below.

The gripping apparatus 216 has a stationary member 270 having a cavity 272 facing the plate 240. A helical spring 274 is received in the cavity 272 and extends between one end 276 of the cavity 272 and the pin 268 of plate 240. In this configuration, the spring 274 is compressed and thus biases the plate 240 forwardly through the pin 268. The stationary member 270 has a rear stop 278 which bears against rearward end 266 of the plate 240 in this configuration of the gripping apparatus 216. The stationary member 270 has an elongated slot 280 extending therethrough and communicating with the second slot 254 of the plate 240. The stationary member 270 also has a forwardly directed cam 282 for a purpose which will be described below. The cam 282 is slidable in the stationary member 270, and may be secured at a desired position by a screw 283.

The gripping apparatus 216 has a movable retaining member 284 connected to and driven by the piston 286 of a cylinder 288. The retaining member 284 has a depending pin 290 extending through slot 280 of stationary member 270 and having a washer 292 received in the second slot 254 of plate 240. The retaining member 284 has a pair of screws 294 and 296 which fixedly secure rearward ends of the resilient nipper 242 and resilient guide 244 to the retaining member 284. The retaining member 284 has a forwardly directed flange 298 having a threaded aperture 300 to receive a screw 302 containing a nut 304 above the flange 298. The outer end of screw 302 bears upon the nipper 242 to bias the nipper 242 toward the plate 240. The screw 302 and nut 304 are adjustable in flange 298, such that the screw 302 may exert an adjustable bias against nipper 242 to accomodate different diameter sizes of threads.

The nipper 242 has an elongated bar 305 connected to a forward end 306 having an outwardly directed finger 308, with the forward end 306 being located near or against the plate 240.

The guide 244 has a forward curved end portion 310 spaced from the finger 308 of the nipper 242 to define a space 312 between the nipper finger 308 and end portion 310 of the guide 244. An outer end 314 of the guide 244 is located above the bar 305 of the nipper 242. In the configuration shown, the guide 244 bears against the cam 282 which raises the end 314 of the guide 244 from the nipper 242 for a purpose which will be described below. When the nipper 242 and guide 244 are moved forwardly by the retaining member 284, as will be described below, the guide 244 becomes disengaged from the cam 282 causing the end 314 of resilient guide 244 to engage against the bar 305 of nipper 242 causing further bias of the nipper 242 against the plate 240.

In operation, prior to severing the chain 210, the plate 240, nipper 242, and guide 244 are allocated beneath the throat plate 220, as shown in FIG. 26, with the forward end of the nipper 242 located adjacent the forward end of the plate 240. With reference to FIGS. 24, 25, and 27, shortly before or after this chain 210 is severed, the cylinder 288 is activated causing forward movement of the retaining member 284 and retained nipper 242 and guide 244. At the same time, the pin 290 moves forwardly in the slot 280 of the stationary member 270, and the moving washer 292 permits forward movement of the spring biased plate 240 to a location with the beveled edge 246 located adjacent the throat plate 220. At this time, the screw 273 of stationary member 270 strikes the second end 252 of first slot 248 and the screw 275 of stationary member 270 strikes the second end 264 of the third slot 260, thus preventing further forward movement of the plate 240 past the throat plate 220. However, with reference to FIGS. 24, 25 and 28, the cylinder 288 continues to drive the retaining member 284, thus moving the retained nipper 242 and guide 244 above the throat plate 220, while the pin 290 leaves the second end 258 of the second slot 254, since the plate 240 is no longer free to move forwardly past the throat plate 220.

In this configuration of the gripping apparatus 216, the severed chain 218 is first moved to one side of the needle by a first blower 330, as shown in FIG. 28, and is then moved by the blower 214 into the space 312 between the nipper 242 and guide 244, with the curved guide 244 directing the chain 218 into the space 312, as shown in FIG. 29.

At this time, the cylinder 288 begins to retract the nipper 242 and guide 244 until the forward end of the nipper 242 is located adjacent the forward end of the plate 240 at the level of the throat plate 220. The severed chain 218 thus becomes caught between the finger 308 of the nipper 242 and the forward portion of the plate 240. Also, at this time, the washer 292 again engages against the second end 258 of second slot 254, and further retraction of the retaining member 284 also causes retraction of the plate 240 along with the nipper 242 and guide 244.

As previously discussed, when the guide 244 leaves the cam 282, the outer end 314 of the guide 244 is biased against the nipper 242 to apply an increased bias to the nipper 242 against the plate 240 in order to draw the chain 218 taut as the nipper 242 and guide 244 move beneath the throat plate 220.

The cylinder continues to retract the nipper 242 and guide 244 beneath the throat plate 220, while driving the plate 240 through pin 290 to the configuration shown in FIG. 30 with the gripping apparatus 216 beneath the throat plate 220, with the chain 218 located in a groove 316 between the throat plate 220 and a conventional fabric cutter 318, and with the plate 240 striking the stop 278. At this time, the guide 244 engages the cam 282, and the end 314 of guide 244 becomes disengaged from the nipper 242 to provide a lessened bias between the nipper 242 and plate 240. Although the chain 218 is drawn taut beneath the top of throat plate 220, the lessened bias of the nipper 242 permits easy removal of the chain 218 from the nipper 242 and plate 240 to prevent distortion of the first few stitches of the next sewn fabric. As previously discussed, the chain 218 is released from the gripping apparatus as the next fabric is sewn over the chain resulting in the sewn fabric of FIG. 31.

Another embodiment is shown in FIGS. 33-37, in which like reference numerals designate like parts. In this embodiment, the sewing machine has a throat plate 350, a feed dog 352, a conventional cutting device 354 having an upper cutting edge 356 and a lower cutting edge 358, and a forward notch 360 in the throat plate 350 located intermediate the feed dog 352 and cutting device 354. The throat plate 350 has a rearwardly directed stitch tongue 362, and a presser foot 364 located adjacent the stitch tongue 362. As shown in FIG. 37, the presser foot 364 has a blower 366 which is directed toward the stitch tongue 362.

The sewing machine has a slot 368 to which vacuum is applied, a tube 370 leading to a first blower 372, and a second blower 374. The throat plate 350 has a reflecting surface 376, and a photosensor 378 located above the surface 376 to determine when fabric passes past the photosensor 378.

The sewing machine also has a grasping device, as shown in FIGS. 33 and 34, substantially as previously described having an elongated lower plate 240, an elongated nipper 242, and an elongated guide 244. The grasping device also has a cylinder 380 disposed below the lower plate 240 having a piston 382. When the cylinder 380 is actuated, the piston 382 is received through an opening 384 of the lower plate 240, and engages against the lower surface of the nipper 242 to move the nipper 242 away from the lower plate 240. The grasping device has a third blower 386 directed toward the space between the nipper 242 and guide 244.

In operation, after a piece of fabric has been sewn a chain of stitches is formed in the trailing edge of the fabric and the stitch tongue 362, as will be further described below. Next, the chain of stitches which is loosely formed on the stitch tongue 362 is blown off the stitch tongue 362 by the blower 366 on the presser foot 364, and the chain of stitches is captured in the vacuum slot 368. The chain of stitches is released by the vacuum slot, and the first and second blower 372 and 374 move the chain of stitches forwardly of the needle where the chain is grasped between the nipper 342 and lower plate 340, as previously described and shown in FIG. 33, while the chain is retained in the notch 360 intermediate the feed dog 352 and cutting device 354.

When a subsequent piece of fabric is being sewn, the machine counts stitches in the fabric, such as 10 to 12, and the cylinder 380 is then actuated to move the nipper 242 away from the lower plate 240, and release the chain of stitches. At the same time, the third blower 386 is actuated to move the chain of stitches in the path of the cutting device 354, as shown in FIG. 34, and the chain is then cut by the cutting device 354 as the fabric moves past the needle. With reference to FIG. 32, this operation results in a shorter chain 218 sewn into the fabric to provide a neater appearance of the fabric.

With reference to FIG. 38, the sewing machine has a tensioning device 388 and a conventional stitch forming instrumentality 390 to form an overedge stitch of Federal Specification 504-ssa-1. As known, the stitch forming instrumentality comprises an upper looper thread eyelet 392, an auxiliary looper thread eyelet 394, a lower looper thread eyelet 396, a fabric guard bracket 398, a frame looper thread guide 400, a presser arm 402, a looper thread pull-off 404, a needle thread cam pull-off 406, a needle thread eyelet 408, a top cover needle thread eyelet 410, an upper looper thread tube assembly 412, a needle 414, an upper looper 416, and a lower looper 418 which cooperate in a known manner to form the overedge stitch.

The tensioning device 388 has first tensioning means 420, second tensioning means 422, a third tensioning means 424, fourth tensioning means 426, fifth tensioning means 428, and sixth tensioning means 430. The first tensioning means 420 is of conventional nature and applies a constant tension to a first thread 432. The second tensioning means 422 is of conventional nature and applies a constant tension to a second thread 434. The third tensioning means 424 is of conventional nature and applies a constant tension to a third thread 436.

The fourth, fifth, and sixth tensioning means 426, 428, and 430 are of the type illustrated in FIG. 39, and will be described in connection with the tensioning means 426. The tensioning means 426 has a lower plate 438, and an upper plate 440 biased by a helical spring 442 against the lower plate 438. The thread 432 passes between the plates 438 and 440, and the plates normally apply tension to the first thread 432. However, the tensioning means 426 has a cylinder 444 with a piston 446 which engages against the upper plate 440 and releases tension on the thread 432 when the cylinder 444 is actuated. The fifth and sixth tensioning means 428 and 430 operate in the same manner. The first, second, and third threads 432, 434, and 436 are connected to the stitch forming instrumentality 390, as shown in the drawing.

During seaming of the fabric and forming an overedge stitch, the fourth and sixth tensioning means 426 and 430 are actuated to release tension on the first and third threads 432 and 436, while the fifth tensioning means 428 applies tension to the second thread 434 to result in the overedge stitch pattern shown in FIG. 40. The sensor 378 indicates when the trailing edge of the fabric passes the sensor 378, and results in the following changes in the tensioning device 388. The fifth tensioning means 428 is actuated to release tension on the second thread 434, while the fourth and sixth tensioning means 426 and 430 apply tension to the first and third threads 432 and 436 resulting in the formation of a chain of stitches, as shown in FIG. 41, on the trailing edge of the fabric. Also, the chain of stitches are loosely formed on the stitch tongue 362 of the throat plate 350 in order that the blower 366 on the presser foot 364 may easily blow the chain off the stitch tongue 362.

A hemmer seamer assembly generally designated 500 of the present invention is illustrated FIGS. 42-48 which replaces the second conveyor 24 of FIG. 1 for use in conjunction with the sleeve handling device 20 described in connection with FIGS. 1-18. The assembly 500 has a sewing machine 502 of the type described in connection with FIGS. 19-41, hereinafter referred to as a latch tacker, and a tensioning device 388, also described in connection with FIGS. 19-41, in the sewing station 184, previously described in connection with FIG. 1, and having the structure with a gripping apparatus 16 previously described in connection with FIGS. 19–41.

Figure 42:
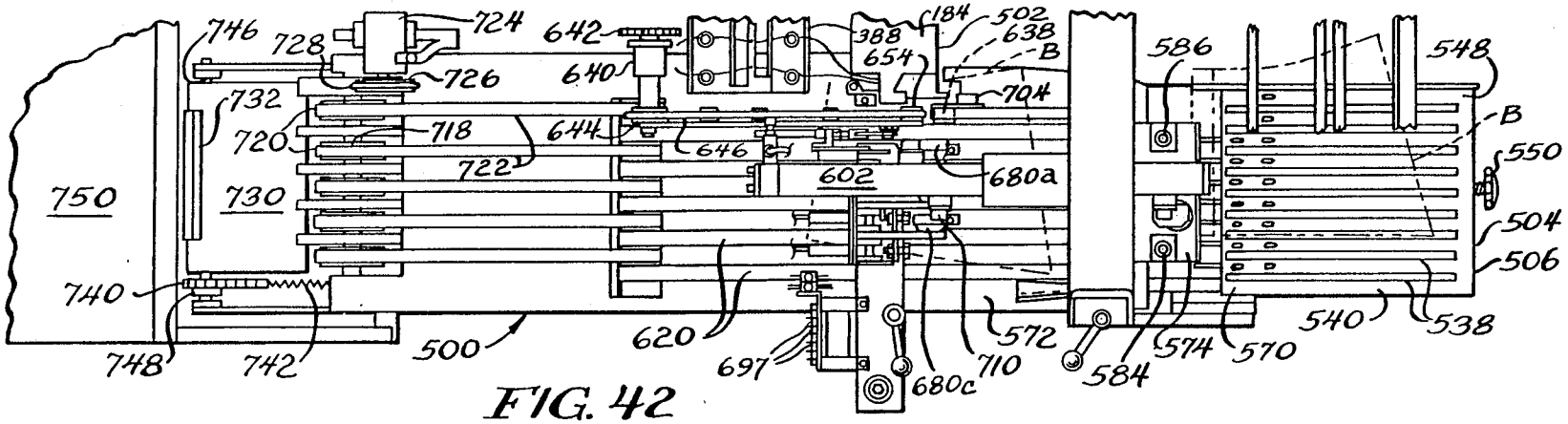
FIG. 42 is a fragmentary top plan view of a hemmer seamer assembly of the present invention.
Figure 43:
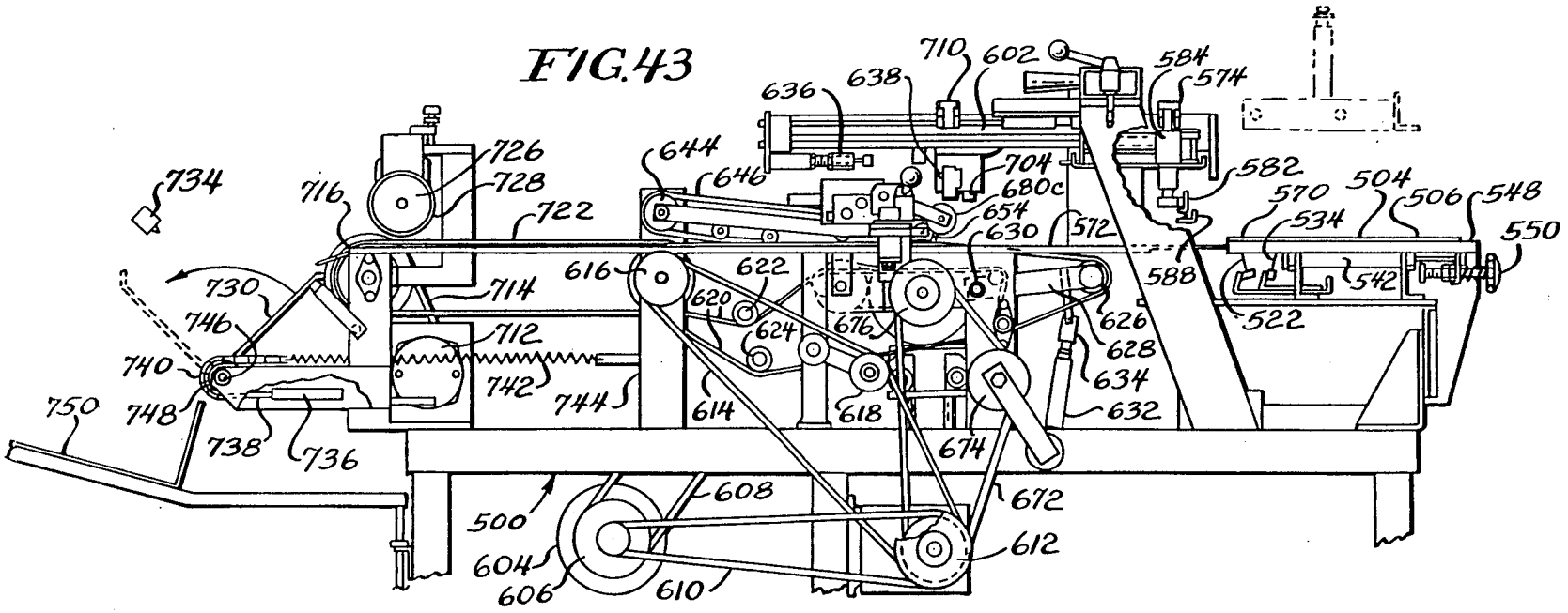
FIG. 43 is a side elevational view of the assembly of FIG. 42.
Figure 44:
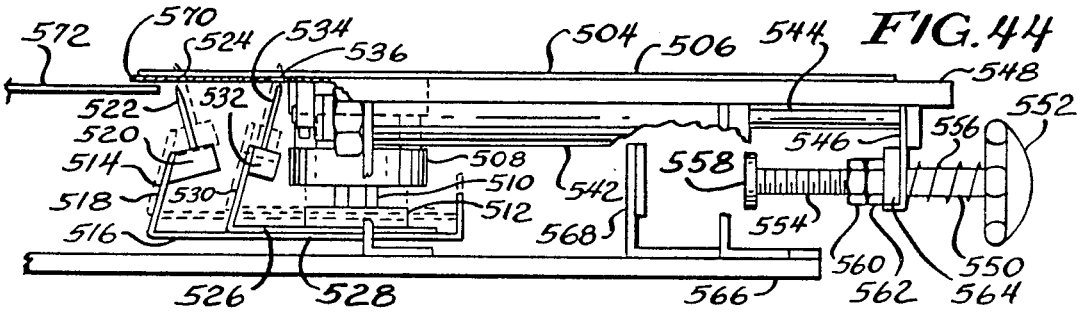
FIG. 44 is a fragmentary side elevational view, taken partly in section, of a table assembly in the seamer assembly of FIG. 42.

With reference to FIGS. 42–44, the assembly 500 has a movable dropoff table assembly 504, and the pickup device 42 previously described in connection with FIG. 1 deposits the folded cloth blank B onto a table 506 of the table assembly 504, with the table 506 positioned to the right as viewed in FIGS. 42–44. The table assembly 504 has a cylinder 508 mounted beneath the table 506, and having a movable piston 510 connected to a plate 512. The assembly 504 has a first arm 514 connected to the plate 512 and having a first forwardly disposed portion 516, and a second upwardly diposed portion 518. An upper end of the second portion 518 is connected to a mounting member 520 in which a plurality of laterally disposed outwardly slanted first set of sharp needles 522 are secured beneath the table 506 and aligned with respective openings 524 in the table 506.

The table assembly 504 also has a second arm 526 having a first forwardly disposed portion 528 and a second upwardly disposed portion 530 with an upper end of the second portion 530 being connected to a second mounting member 532. A second set of inwardly slanted sharp needles 534 are secured to the mounting member 532, and are disposed laterally across the table 506, with the second needles 534 being located beneath the table 506 and aligned with associated openings 536 in the table 506.

The cylinder 508 is controlled by the central processing unit 118 of FIG. 18, and the piston 510 is movable between a first lower position in which the ends of the first and second needles 522 and 534 are located beneath the table 506, and a second upper position in which the ends of the needles 522 and 534 are passed through the respective openings 524 and 536 and are located above the table 506. When the cloth pickup device 42 drops the folded cloth blank B onto the table 506, the needles 522 and 534 are located at their first lower position beneath the table 506. However, when the second upper sensor 170 generates a signal to the central processing unit 118 of of FIG. 18 to drop off the cloth blank B, the central processing unit 118 actuates the cylinder 508 to move the needles 522 and 534 to their second upper position above the table 506 to engage the cloth blank B, such that the needles 522 and 534 grip the cloth blank B in opposite directions to prevent shifting of the cloth blank B on the table 506 as the table 506 is moved. Also, the table 506 has a plurality of elongated longitudinally extending and laterally spaced friction strips 538 on an upper surface 540 of the table 506 to also facilitate the prevention of sliding of the cloth blank B on the upper surface 540 of the table 506.

The table assembly 504 has a second elongated double acting cylinder 542 disposed beneath the table 506, and having a movable piston 544 connected to a flange 546 depending from one end 548 of the table 506. The table assembly 504 has an adjustment screw 550 extending through the flange 546, with the screw 550 having suitable threads 554, an outer adjustment knob 552, a helical spring 556 being biased between the flange 546 and the knob 552, and an inner plate 558. The screw 550 is secured in place at an adjustable position by a pair of threaded nuts 560 and 562 secured on the screw 550, with the spring 556 biasing the screw 550 in an outer direction such that the nuts 560 and 562 engage against a plate 564 secured to the flange 546. As shown, the frame 566 of the assembly 500 has an upwardly directed stop plate 568 against which the plate 558 of the screw 550 strikes as the table assembly 504 moves towards the left as shown in the drawings, as will further be described below.

After the needles 522 and 534 are moved to their upper position to grip the cloth blank B, the central processing unit 118 of FIG. 18 actuates the cylinder 542 to move the piston 544 and table 506 toward the left as viewed in the drawings until the plate 558 of the screw 550 strikes the stop plate 568, with the retained cloth blank B moving along with the table 506. In this configuration, an end portion of the cloth blank B is located past an inner end 570 of the table 506, and the adjustment screw 550 may be utilized to control the amount of travel of the table 506 toward the left, as viewed in the drawings, to compensate for different sized cloth blanks B being dropped off at various points on the table 506 in order to properly index the cloth blanks B when the table 506 is moved to its left inner position, as viewed in the drawings. In the shifted configuration of the table 506, the inner end portion of the cloth blanks B are located above an elongated plate 572 of the seamer assembly 500.

Figure 45:
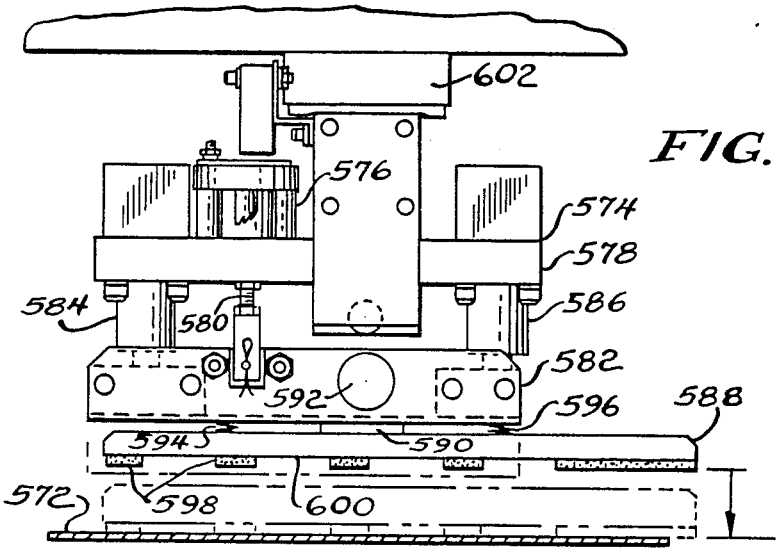
FIG. 45 is a front elevational view of a transport assembly in the assembly of FIG. 42.

With reference to FIGS. 42, 43, and 45, the seamer assembly 500 has a tansport clamp 574. The transport clamp 574 has a cylinder 576 mounted on a lateral plate 578. The cylinder 576 has a movable piston 580 connected to a support member 582, with the transport clamp 574 also having a pair of opposed side bearings 584 and 586 connected to the support member 582 to provide stability to the support member 582 during movement of the piston 580 and support member 582. The transport clamp 574 also has a floating clamp 588 disposed beneath the support member 582 and pivotally connected by a plate 590 to a pivot point 592 of the support member 582, such that opposed lateral ends of the clamp 588 are permitted to move relative to the support member 582, and with the opposed lateral ends of the clamp 588 being biased away from the support member 582 by a pair of opposed helical springs 594 and 596. As shown, the clamp 588 has a plurality of spaced friction strips 598 disposed on a lower surface 600 of the clamp 588 in order to assure proper grip against the cloth blank B.

After the table 506 and retained cloth blank B have been moved or indexed to position the inner end of the cloth blank B beneath the clamp 588, and after a suitable delay by the central processing unit 118 of FIG. 18, the central processing unit 118 actuates the cylinder 576 in order to lower the support member 582 and floating clamp 588 into a position with the clamp 588 griping the inner end of the cloth blank B against the plate 572, with the floating clamp 588 pivoting to accommodate the particular size and thickness of the cloth blank B to assure a firm grip of the cloth blank B between the clamp 588 and plate 572. As the inner end of the cloth blank B is captured beneath the clamp 588, the central processing unit 118 of FIG. 18 actuates the cylinder 508 in order to lower the needles 522 and 534 in order to release the material by the needles from the table assembly 504.

The transport clamp or asembly 574 is movably connected to an elongated cylinder 602 of the type sold under the trademark Tol-O-matic, sold by Fluid Power Engineering Co., Inc. of Chicago, Illinois, in order to move the transport clamp 574 and retained cloth blank B from a first position adjacent the table assembly 504 towards a second position adjacent the latch tacker 502. Once the clamp 588 has gripped the inner end of the cloth blank B, and the needles 522 and 534 have been lowered, the central processing unit 118 of FIG. 18 actuates the cylinder 602 to move the transport assembly 574 to its second position with the cloth blank B, and actuates the cylinder 542 to return the table assembly 504 to its initial position to receive a subsequent cloth blank B in order to facilitate speed of production.

With reference to FIGS. 42 and 43, the seamer assembly 500 has a motor 604 with a pulley 606 driven by the motor 604. An endless belt 608 passes around the pulley 606, and is driven by the motor 604 in order to drive the sewing head of the latch tacker 502. A second endless belt 610 passes around the pulley 606 and is driven by the pulley 606 of the motor 604, and the belt 610 passes around and drives a roatatably mounted speed reducer 612.

An endless belt 614 passes around and is driven by the speed reducer 612, with the belt 614 also passing around and driving a rotatably mounted roller 616, and with the belt 614 also passing over a rotatably mounted roller 618. In turn, a plurality of laterally disposed endless transport belts 620 are driven by the roller 616, with the transport belts 620 passing over rotatably mounted rollers 622 and 624, and a movable roatatably mounted roller 626. As shown, a left hand portion of the transport belts 620 adjacent the roller 616 are disposed through suitably laterally enlongated openings in the plate 572 at a location above the plate 572. However, the roller 626 disposed furthest away from the roller 616 toward the right hand portion of the plate 572, as viewed in the drawings, is rotatably mounted on a bracket 628 which is pivotally mounted about a pivot point 630. The seamer assembly 500 has a cylinder 632 having a movable piston 634 connected to the bracket 628 in order to move the right hand portion of the transport belts 620 from a first inoperative position beneath the plate 572, and a second operative upper position through suitable laterally disposed longitudinal openings in the plate 572 above the plate 572.

As the cylinder 602 moves the transport clamp 574 toward its second position adjacent the latch taker 502, the central processing unit 118 of FIG. 18 controls the cylinder 632 to place the portions of the transport belt 620 moving about the rollers 626 below the plate 572 in order to prevent obstruction with the moving cloth blank B, for a purpose which will be described below.

In this configuation, the cylinder 602 moves the transport clamp and retained cloth blank B along the plate 572 toward the latch tacker 502 until the transport clamp 574 strikes a bumper 636 in order to stop movement of the transport claim 574. At the same time, a sew sensor 638, such as a suitable photoelectric sensor, is located to sense the leading edge of the cloth blank B in order to indicate that the material is at the proper position for sewing. In the event the sew sensor 638, which is electrically connected to the central processsing unit 118 of FIG. 18, is not sensed, then the adjustment screw 550 is modified to vary the distance the cloth blank B is moved under the floating clamp 588 until the sew sensor 638 is satisfied when the transport clamp 574 strikes the bumper 636.

When the adjustment screw 550 is properly modified in order to obtain proper sensing by the sew sensor 638, and the sew sensor detects the leading edge of the cloth blank B, a signal is sent to the central processing unit 118 of FIG. 18, and the central processing unit 118 simultaneously lowers the presser foot 364 of the latch tacker 502, onto the cloth blank B, actuates the cylinder 576 to move the clamp 588 upwardly from the cloth blank B, and actuates the cylinder 632 to move the portion of the transport belts 620 adjacent the roller 626 through the associated openings to a location above the plate 572. At this time, the latch tacker 502 begins sewing of the cloth blank B, as will be further discussed below, and the central processing unit 118 of FIG. 18 actuates the cylinder 602 in order to return the transport clamp 574 to its home first position adjacent the table assembly 504 in order to process a subsequent cloth blank B for improved speed and automation of the seamer assembly 500.

With reference to FIGS. 42, 43, 46, and 47, the seamer assembly 500 has a rotatable roller 640 located above the plate 572 driven by a chain 642 from the drive roller 616. In turn, the roller 640 drives a grooved rotatable pulley 644. An endless belt 646 passes around and is driven by the pulley 646. The belt 646 passes around rollers 648, 650 and 651 which provide pressure drive points of the belt 646 against the plate 572, with the rollers 648, 650 and 651 being pivotally mounted to a bracket 652 for a purpose which will be described below. The belt 646 also passes around an end roller 654 which is roatably mounted on the bracket 652, with the bracket 652 being pivotally mounted on a shaft 656 associated with the pulley 644.

The seamer assembly 500 has a cylinder 658 controlled by the central processing unit 118 of FIG. 18. The cylinder 658 has a movable piston 660 pivotally connected to an arm 662 by a pin 664, with the arm 662 being pivotally mounted on a pivot shaft 666. An outer end of the arm 662 has a slot 668 to slidably receive a pin 670 connected to the bracket 652. In a first configuration, with the piston 660 of the cylinder 658 extended, the roller 654 is located at a first lower position with the associated portion of the belt 646 located adjacent the plate 572 in a driving position of the device. In a second configuration, with the piston 660 of the cylinder 658 retracted, as shown in dotted lines in FIG. 47, the arm 662 lifts the pin 670 and associated end of the bracket 652 along with the roller 654 and associated portion of the belt 646 in order to lift the rollers 648, 650, 651, and 654 from the plate 572 to an inoperative position for a purpose which will be described below.

The normal shape of the cloth blank B has a first straight portion to be sewn, and the latch tacker 502 begins to sew with the roller 654 located in the lower driving position, and the roller 626 located in the upper driving position in order to move the cloth blank B in a straight line path for a straight line of sewing by the latch tacker 502. After a short time of sewing by the latch tacker 502, as determined by a delay in the central processing unit 118 of FIG. 18, the central processing unit 118 actuates the cylinder 632 in order to lower the associated roller 626 and associated portions of the transport belts 620 below the plate 572 in order to accomodate another sleeve blank B which may be transported by the transport clamp 574 towards the latch tacker 502 for improved automation of the seamer assembly 500. However, at this time, the upper portion of the transport belt 620 adjacent the roller 616 are still operating at a location above the plate 572 in order to further move the cloth blank B through the latch tacker 502. In this manner, a straight line of stitching may be sewn by the latcher tacker 502 onto the initial end of the cloth blank B.

Figure 46:
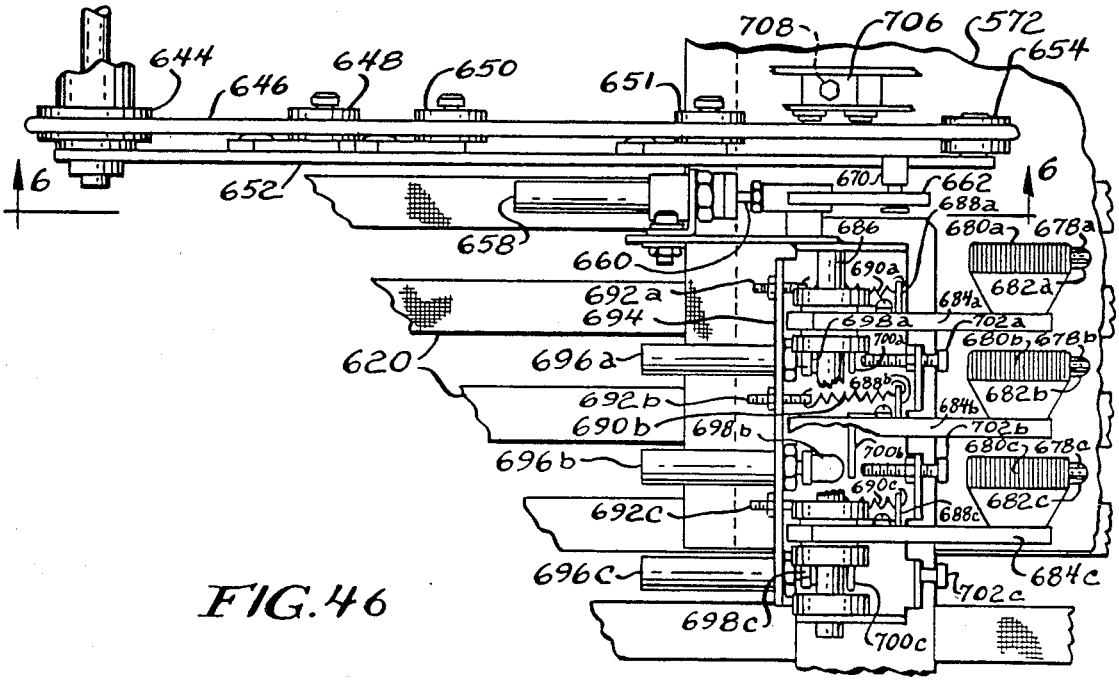
FIG. 46 is a fragmentary top plan view of a device for turning a cloth blank while being sewn by the assembly of FIG. 42.
Figure 47:
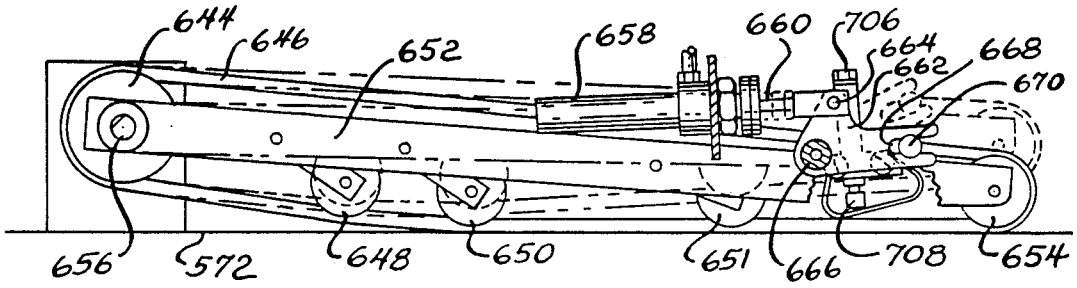
FIG. 47 is a side elevational view showing an upper belt assembly for moving a cloth blank during sewing.

However, typically, the cloth blank B has a curved portion to be sewn by the latch tacker 502, and the line of stitching by the latch tacker 502 accomodates this curved portion, as will be discussed below. With reference to FIGS. 42, 43, and 46, an endless belt 672 passes around and is driven by the speed reducer 612. The belt 672 passes over a rotatable roller 674, and a rotatable roller 676. In turn, the roller 676 drives a plurality of wheels 678*a*, 678*b*, and 678*c* associated with respective curve rollers 680*a*, 680*b*, and 680*c*. The wheels 678*a*, *b*, and *c* project slightly above the plate 572 through associated openings 682*a*, 682*b*, and 682*c* with the wheels being driven at progressively faster rotational speeds in a direction away from the latch tacker 502, i.e., wheel 678*b* is driven at a faster rotational speed than wheel 678*a*, and wheel 678*c* is driven at a faster rotational speed than wheel 678*b*.

Figure 49:
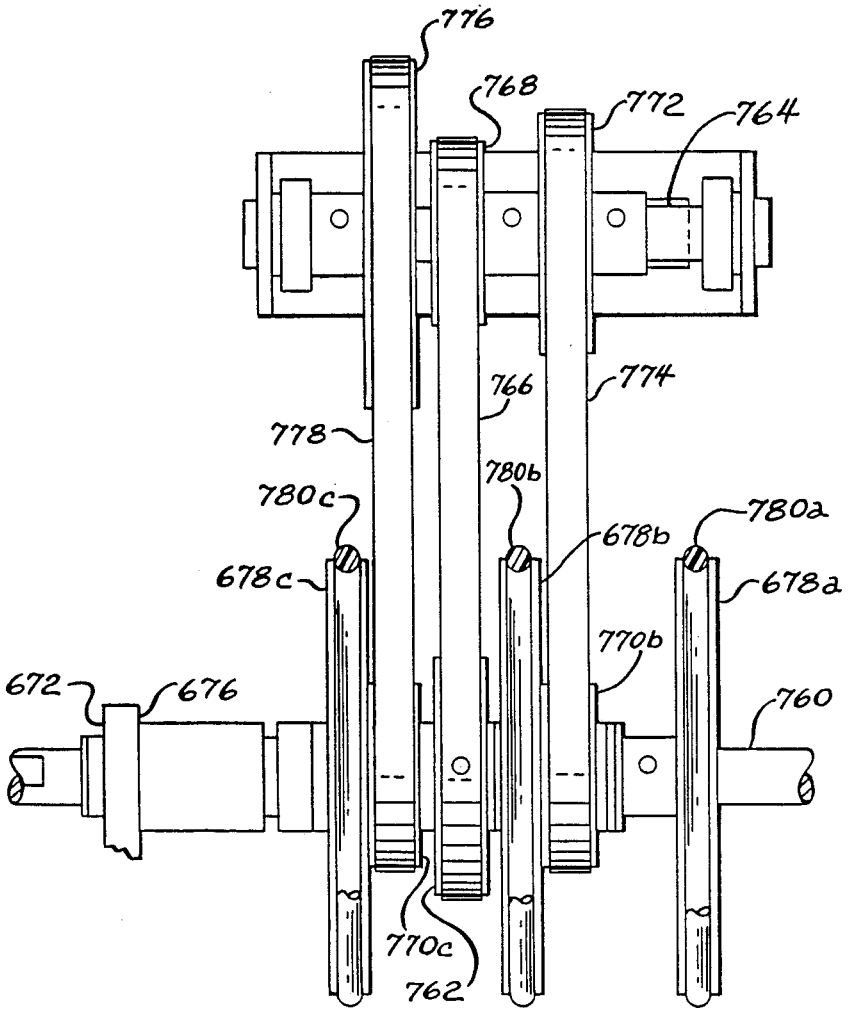
FIG. 49 is a diagrammatic view of a drive assembly for the device of FIG. 46.

With reference to FIG. 49, the roller 676 drives a shaft 760, and the wheel 678*a* is fixedly secured to the shaft 760 in order to drive the wheel 678*a* at a first rotational speed, while the wheels 678*b* and 678*c* are free to rotate relative to the shaft 760. A pulley 762 is fixedly secured to the shaft 760, and drives a rotatable shaft 764 by an endless belt 766 which passes around a pulley 768 fixedly mounted to the shaft 764. The wheel 678*b* has a free wheeling pulley 770*b* secured to the wheel 678*b*, and the wheel 678*c* has a free wheeling pulley 770*c* secured to the wheel 678*c*. A pulley 772 of a first outer diameter greater than the diameter of the pulley 768 is secured to the shaft 764, and drives the wheel 678*b* at a rotational speed greater than the wheel 678*a* by an endless belt 774 which passes around the pulleys 770*b* and 772 due to the diameter of the pulley 772. A pulley 776 of a second outer diameter greater than the diameter of the pulley 772 is secured to the shaft 764, and drives the wheel 678*c* at a rotational speed greater than the wheel 678*b* by an endless belt 778 which passes around the pulleys 770*c* and 776. In a preferred form, the pulleys 762, 770*b*, 770*c*, 772, 768, and 776 and associated belts 766, 774, and 778 have meshing cogs to facilitate driving operation of the device. As shown, the wheels 678*a*, *b*, and *c* have respective elastic rings 780*a*, 780*b*, and 780*c* extending around the associated wheels to drive fabric above the plate 572.

The curve roller 680*a*, *b*, and *c* are pivotally mounted on associated outer ends of arms 684*a*, 684*b*, and 684*c*, with the other ends of the arms 684*a*, *b*, and *c* being pivotally mounted on a shaft 686. The arms 684*a*, *b*, and *c* have associated flanges 688*a*, 688*b*, and 688*c* to receive one end of associated helical springs 690*a*, 690*b*, and 690*c*, with the other end of the springs 690*a*, *b*, and *c*, being connected to associated bolts 692*a*, 692*b*, and 692*c* which are adjustably secured in an elongated backet 694. The springs 690*a*, *b*, and *c* bias the associated curve roller 680*a*, *b*, and *c* downwardly toward the plate 572 and against the associated wheels 678*a*, *b*, and *c*.

The device has associated cylinders 696*a*, 696*b*, and 696*c* which are controlled by the central processing unit 118 of FIG. 18, with the cylinders 696*a*, *b*, and *c*, having associated movable pistons 698*a*, 698*b*, and 698*c*, and with the cylinders 696*a*, *b*, and *c* having associated solenoid valves 697. The arms 684*a*, *b*, and *c* have associated actuating flanges 700*a*, 700*b*, and 700*c*, and when the pistons 698*a*, *b*, and *c* are extended from the associated cylinder 696*a*, *b*, and *c*, the pistons 698*a*, *b*, and *c* drive the flanges 700*a*, *b*, and *c* and associated arms 684*a*, *b*, and *c* and pivotally connected curve rollers 680*a*, *b*, and *c* to an upper position above the plate 572 and away from the associated wheels 678*a*, *b*, and *c* in disengagement with the cloth blank B. In normal operation of the device, pistons 698*a*, *b*, and *c* are extended, such that the associated curve rollers 680*a*, *b*, and *c* are located at a position above the plate 572. As shown, the pistons 698*a*, *b*, and *c* can be extended until the associated flanges 700*a*, *b*, and *c* strike adjustable screws 702*a*, 702*b*, and 702*c* which may be adjusted to limit the upper movement of the curve rollers 680*a*, *b*, and *c* by the associated cylinders 696*a*, *b*, and *c*, above the plate 572. The cylinders 696*a*, *b*, and *c* are independently actuated by the central processing unit 118 of FIG. 18 for a purpose which will be described below.

Since the cloth blanks B have variying widths and amount and length of curvature, a program unit P is controlled by the operator in association with the central processing unit 118 of FIG. 18 in order to input the appropriate data for the blanks B to the central processing unit 118 to provide information on the delay for the straight line sewn portion associated with the cloth blanks B, the width of the cloth blanks B, and the parameters associated with the amount of curvature and length of curvature of the cloth blanks B in order to independently control the cylinders 696*a*, *b*, and *c* and associated curve rollers 680*a*, *b*, and *c*. Thus, the operator indicates through the programming unit P the width of the particular cloth blank B to be sewn in order to determine the number of curve rollers 680*a*, *b*, and *c* to be utilized in sewing the curved path of the cloth blank B by the latch tacker 502, and the duration of time that the curve rollers 680*a*, *b*, and *c* are in operation to produce the curved sewing line on the cloth blank B. When the desired curve rollers 680*a*, *b*, and *c* are actuated by the associated cylinders 696*a*, *b*, or *c* they move downwardly against the associated wheels 678*a*, *b*, or *c* to form pinch points in driving the cloth blank B in a curved path as programmed in association with the latch tacker 502 to sew the curved stitch line on the cloth blank B, since the wheels 678*a*, *b*, or *c* move at a faster angular speed away from the latch tacker 502 in engagement with the cloth blank B to drive the cloth blank B in a curved path between the wheels 678*a*, *b*, or *c* and the associated curve rollers 680*a*, *b*, or *c*, while the wheels 678*a*, *b*, or *c* and associated curve rollers 680*a*, *b*, or *c* turn the cloth blank B while being stitched by the latch tacker 502.

Thus, after a suitable delay, as determined by the programming unit P and the central processor 118 of FIG. 18 normally for a straight line stitching, the curve rollers programmed by the programming unit P are actuated by the central processing unit 118 through the associated cylinders in order to produce the curved line of stitching in the cloth blank B. Of course, the initial portion of the cloth blank B may be curved by inhibiting the delay. During this time, the belt 646 and transport belt 620 adjacent the roller 616 cause continued movement of the cloth blank B through the latch tacker 502 during stitching of the curved line of the cloth blank B.

In this manner, the cloth blank B is sewn its length until a sensor 704, such as a suitable photoelectric sensor, detects the presence of the trailing edge of the cloth blank B. At this time, the central processing unit 118 of FIG. 18 provides a signal to the motor 604 in order to stop operation of the belt 646, the transport belts 620, and the sewing head of the latch tacker 502. At the same time, the central processing unit 118 actuates the cylinder 288 in order to move the gripping apparatus 216 of the latch tacker 502 to its operative upper catching position, and the central processing unit 118 actuates the cylinder 658 in order to lift the roller 654 and associated end portion of the bracket 652 above the plate 572 in order to permit passage of the chain beneath the belt 646, as will be further described below. With reference to FIG. 46, the central processing unit 118 of FIG. 18 also actuates a cylinder 706 in order to drive a lower piston 708 into engagement with the cloth bank B against the plate 572 in order to stop movement of the cloth blank B. Further, at this time, the latch tacker 502 blows the chain off the stitch tongue and the chain is cut by the knife on the latch tacker 502, and the blowers, such as blower 14 of the latch tacker 502, are actuated to blow the chain around to the gripping apparatus 216 of the latch tacker 502, with the chain passing beneath the upwardly moved roller 654 and associated portion of the belt 646, with the latch tacker 502 operating as previously described during this time. Next, the central processing unit 118 of FIG. 18 actuates the cylinder 706 in order to lift the piston 708 from the sewn sleeve S, the central processing unit actuates cylinder 288 to lower the gripping apparatus 216 and grasped chain to its lower position for a subsequent cloth blank B, and the central processing unit 118 of FIG. 18 actuates the cylinder 658 to lower the roller 654 and end portion of the belt 646 to its lower position against the plate 572 for further operation in movement of the sleeve B. At this time, the sleeve S, as shown in FIG. 17, has been completely sewn with the line of stitching L in the cloth blank B, and the chain 218 sewn into the line of stitching 229, as shown in FIG. 32. The sewn sleeve S remains in place adjacent the latch tacker 502 to await the next cloth blank B advancing toward the latch tacker 502 by the transport clamp 574, and the further operation of the seamer assembly 500 will be described below in order to advance the sewn sleeve S for stacking.

However, in the event that the transport clamp 574 advances a subsequent cloth blank B towards the latch tacker 502 before sewing by the latch tacker 502 in a previous cloth blank B has been completed, a standby sensor 710 detects presence of the transport clamp 574, and the central processing unit 118 of FIG. 18 actuates the cylinder 602 in order to stop movement of the transport clamp 574 until completion of sewing of the current cloth blank B by the latch tacker 502, after which the stopped transport clamp 574 is advanced for sewing the subsequent cloth blank B.

In this regard, the roller 626 and associated portion of the transport belts 620 are lowered at this time, in order to permit the subsequent cloth blank B to be advanced as close as possible to the latch tacker 502 to enhance the speed of operation of the seamer assembly 500.

As previously indicated, after completion of sewing of the sleeve S by the latcher tacker 502, the seamer assembly 500 awaits advancement of a subsequent cloth blank B as sensed by the sew sensor 638. At this time, the central processing unit 118 of FIG. 18 actuates operation of the motor 604 in order to start movement of the transport belts 620 and lowered belt 646, causing movement of the completed sleeve S away from the latch tacker 502, and initiation of sewing of the subsequent cloth blank B.

Figure 48:
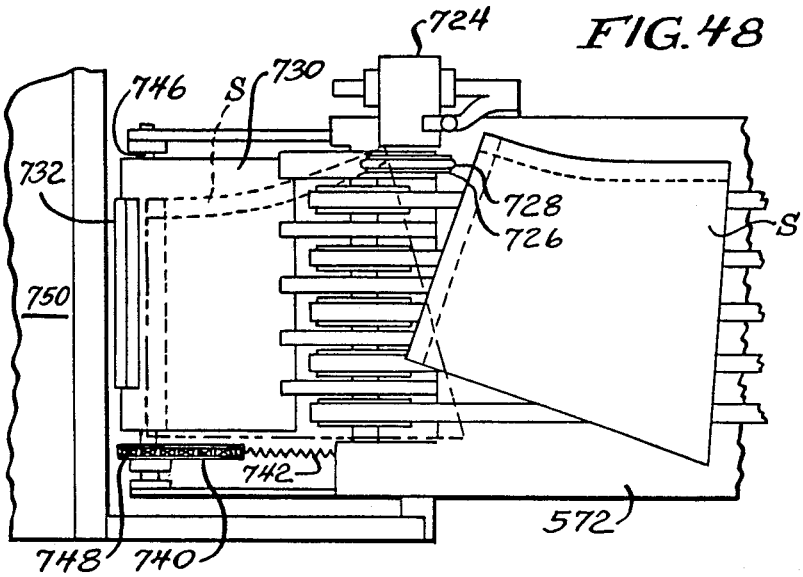
FIG. 48 is a fragmentary top plan view illustrating a device to straighten a sewn sleeve for stacking.

With reference to FIGS. 42, 43, and 48, the seamer assembly 500 has a motor 712 which drives an endless belt 714 about a pulley 716 connected to a rotatable shaft 718. The shaft has a plurality of pulleys 720 to drive a plurality of associated stacking belts 722, with a portion of the belt 722s being located above the plate 572. In a perferred form, the motor 712 continuously drives the stacking belts 722 irrespective of operation of the motor 604.

The now moving transport belts 620 and upper belt 646 move the completed sleeve S onto the stacking belts 722 which further move the completed sleeve S towards the outer end of the seamer assembly 500.

With reference to FIG. 48, the sewn sleeve S on the stacker belts 722 is turned somewhat sideways due to sewing of the curve by the latch tacker 502, and it is desirable to straighten the sleeve S for subsequent stacking, as will be described below. With reference to FIGS. 42, 43, and 48, the seamer assembly 500 has a motor 724 which drives a disc 726 having an outer elastic ring 728 extending around the disc 726 with the disc 726 and ring 728 being located slightly above the plate 572. As the sleeve S passes between the ring 728 and plate 572, the disc 726 and ring 728 grips and pivots the sleeve S into a straightened configuration, as shown by dotted lines in FIG. 48. The amount the discs 726 and ring 728 turn the sleeve S is determined by the rotational speed of the motor 724, and the motor 24 may be adjusted by the operator to vary the rotational speed of the disc 726 and ring 728 to provide variable amounts of alignment of the sleeve S depending upon the amount the sleeve S was turned by the latch tacker 502 during sewing of the curvature in the sleeve S. Thus, the operator may adjust the motor 724 in order to control alignment of the sleeve S by the disc 726 and ring 728 for subsequent stacking of the sleeves S in a straight configuration.

With references to FIGS. 42, 43, and 48, the aligned sleeve S passes onto a flapper 730 until it strikes an abutment member 732 at a lower end of the flapper 730. At this time, a sensor 734 detects presence of the sleeve S on the flapper 730, and indicates presence of the sleeve S to the central processing unit 118 of FIG. 18.

The seamer assembly 500 has a cylinder 736 located beneath the flapper 730, with the cylinder 736 having a movable piston 738. The piston 738 is connected to one end of a chain 740, and the other end of the chain 740 is connected to an elongated helical spring 742, with the spring extending to a post 744 of the seamer assembly 500. The flapper 730 is secured to a pivotal shaft 746, and the chain 740 engages a gear 748 secured to the shaft 746.

In the normal configuration of the device, the piston 738 is extended from the cylinder 736 with the flapper 730 located in the upper slanted position, as shown in solid lines in the drawings. However, when the sensor 734 senses presence of a completed sleeve S on the flapper 730, the central processing unit 118 of FIG. 18 actuates the cylinder 736 in order to retract the piston 738, and move the chain 740 against the bias of the spring 742 and move the flapper 730 to an outer tilted position, as shown in dotted lines in the drawings, in order to drop the completed sleeves S in a stacked configuration into a tray 750 with the sleeves S in alignment with each other for subsequent handling.

As previously discussed, the transport clamp 574 is moved until the transport clamp 574 strikes the bumper 636, and the sew sensor 638 senses the leading edge of the cloth blank B. As previously discussed, if the sew sensor 638 does not detect presence of the cloth blank B, the adjustment screw 550 is modified to produce this result.

In an alternative form, the adjustment screw 550 may be eliminated from the table assembly 504 by moving the transport clamp 574 towards the latch tacker 502 without use of the bumper 636 until the sew sensor 638 detects the leading edge of the cloth blank B irrespective of the relationship of the cloth blank B to the clamp 588. In this embodiment, once the central processing unit 118 determines that the sew sensor 638 has detected the leading edge of the cloth blank B, the central processing unit 118 actuates the cylinder 602 to stop operation of the transport clamp 574, and initiate the sewing sequence by the latch tacker 502, as previously described above. In this manner, no manual adjustment by the screw 550 is required, and the seamer assembly 500 is rendered in a more automatic condition.

The foregoing detailed description is given for clearness of understanding only, and no unnecessary limitations should be understood therefrom, as modifications will be obvious to those skilled in the art.

What is claimed is:

1. A device for manipulating a sewn fabric, comprising;

means for sewing the fabric resulting in placement of the fabric at a turned configuration;

means for moving the fabric away from the sewing means; and means for turning the sewn fabric into a desired configuration.

2. The device of claim 1 wherein the turning means is disposed in association with the moving means.

3. The device of claim 1 including means for adjusting the turning means to turn the fabric a variable amount.

4. The device of claim 1 wherein the turning means comprises a rotatable disc disposed to engage an upper surface of the fabric, and means for rotating the disc.

5. The device of claim 4 wherein the disc includes an elastic ring extending around the periphery of the disc.

6. The device of claim 4 including means for adjusting the speed of the rotating means.

7. The device of claim 1 including means for stitching the sewn fabric turned into the desired configuration.

8. The device of claim 1 wherein the sewing means sews a curved portion of the fabric resulting in placement of the fabric at the turned configuration.

* * * * *